US011592760B2

(12) United States Patent
Tanaka et al.

(10) Patent No.: US 11,592,760 B2
(45) Date of Patent: Feb. 28, 2023

(54) IMAGE FORMING APPARATUS THAT DETECTS SURFACE POTENTIAL OF IMAGE CARRIER WITH HIGH ACCURACY

(71) Applicant: KYOCERA Document Solutions Inc., Osaka (JP)

(72) Inventors: Kazunori Tanaka, Osaka (JP); Yoshihiro Yamagishi, Osaka (JP); Tamotsu Shimizu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/507,024

(22) Filed: Oct. 21, 2021

(65) Prior Publication Data

US 2022/0128925 A1 Apr. 28, 2022

(30) Foreign Application Priority Data

Oct. 23, 2020 (JP) ..... JP2020-178039
Oct. 23, 2020 (JP) ..... JP2020-178040
Oct. 23, 2020 (JP) ..... JP2020-178041

(51) Int. Cl.
*G03G 15/06* (2006.01)
*G03G 15/00* (2006.01)
*G03G 15/02* (2006.01)

(52) U.S. Cl.
CPC ..... *G03G 15/065* (2013.01); *G03G 15/0266* (2013.01); *G03G 15/5037* (2013.01)

(58) Field of Classification Search
CPC ..... G03G 15/065; G03G 15/0266; G03G 15/5037
See application file for complete search history.

(56) References Cited

U.S. PATENT DOCUMENTS

2017/0160668 A1* 6/2017 Fujihara ..... G03G 15/0266

FOREIGN PATENT DOCUMENTS

JP 2003-295540 A 10/2003
JP 2015191079 A * 11/2015 ..... G03G 15/065

OTHER PUBLICATIONS

Translation of JP-2015191079 (Year: 2015).*

* cited by examiner

*Primary Examiner* — Arlene Heredia
(74) *Attorney, Agent, or Firm* — IP Business Solutions, LLC

(57) ABSTRACT

An image forming apparatus includes a developing device that forms a toner image, by developing an electrostatic latent image formed on a photoconductor drum, a charging device that electrically charges the photoconductor drum, a developing power source that applies a predetermined developing bias voltage to the developing device, and a calculation device that calculates a surface potential of the photoconductor drum, on a basis of the developing current flowing in the developing device. The developing power source applies the developing bias voltage in a plurality of levels, to the developing device. A current measurement device measures a developing current, with respect to the developing bias voltage of each level. The calculation device calculates the surface potential, on the basis of each developing current.

9 Claims, 23 Drawing Sheets

Fig.7

| BIAS VOLTAGE [V] | DEVELOPING CURRENT [μA] |
|---|---|
| 220 | −0.31 |
| 240 | −0.15 |
| 300 | 0.12 |
| 320 | 0.26 |

Fig.12

| CHARGING BIAS [V] | DEVELOPING BIAS VOLTAGE [V] | DEVELOPING CURRENT [μA] |
|---|---|---|
| 280 | 250 | 1.8 |
| 320 | 250 | 0.5 |
| 360 | 250 | −0.4 |
| 400 | 250 | −1.2 |

Fig. 17

| DEVELOPING CURRENT [V] | DEVELOPING BIAS VOLTAGE [μA] |
|---|---|
| 220 | −0.31 |
| 240 | −0.15 |
| 300 | 0.12 |
| 320 | 0.26 |

Fig.19

| ROTATION SPEED[mm/sec] | SURFACE POTENTIAL[V] |
|---|---|
| 245 | 253 |
| 183 | 247 |
| 122 | 244 |
| 80 | 241 |

Fig.21

| ROTATION SPEED[mm/sec] | SURFACE POTENTIAL[V] |
|---|---|
| 280 | 273 |
| 210 | 265 |
| 140 | 260 |

IMAGE FORMING APPARATUS THAT DETECTS SURFACE POTENTIAL OF IMAGE CARRIER WITH HIGH ACCURACY

INCORPORATION BY REFERENCE

This application claims priority to Japanese Patent Application No.2020-178039 filed on Oct. 23, 2020, Japanese Patent Application No.2020-178040 filed on Oct. 23, 2020, and Japanese Patent Application No.2020-178041 filed on Oct. 23, 2020, the entire contents of which are incorporated by reference herein.

BACKGROUND

The present disclosure relates to an image forming apparatus.

In image forming apparatuses based on electrophotography, such as a copier and a printer, an image forming process including applying a toner to an electrostatic latent image, formed by exposing the surface of a uniformly charged photoconductor drum (image carrier), and developing the latent image into a toner image, is widely employed. To obtain a high-quality image, it is required to develop the image with a development bias having an appropriate potential difference, with respect to the surface potential of the photoconductor drum.

Therefore, it is necessary to detect the actual surface potential of the photoconductor drum to be used for the image forming, and for such purpose a surface potential sensor has thus far been employed, to detect the surface potential of the photoconductor drum.

However, the surface potential sensor is expensive, and besides the sensor may fail to accurately detect the surface potential, for example when the toner that has splashed is stuck to the surface potential sensor. Accordingly, an electrophotography apparatus, capable of acquiring the surface potential of the photoconductor drum, without depending on the surface potential sensor, which is expensive, has been proposed.

The mentioned electrophotography apparatus is configured to form a pulsed electrostatic potential pattern on a photosensitive body, applying a bias to a developing roller, and measuring the current flowing from the photosensitive body to the developing roller when developing the electrostatic potential pattern, thereby acquiring the surface potential on the photosensitive body. More specifically, the surface potential on the photosensitive body is estimated, by monitoring the current at a point where the pulsed electrostatic potential pattern is switched. Through such an arrangement, the surface potential on the photosensitive body can be acquired, without using the surface potential sensor.

SUMMARY

The disclosure proposes further improvement of the foregoing technique.

In an aspect, the disclosure provides an image forming apparatus including an image carrier, a charging device, a developing device, a developing power source, a current measuring device, and a calculation device. On a surface of the image carrier, an electrostatic latent image is formed. The charging device electrically charges the image carrier. The developing device forms a toner image, by supplying toner to the image carrier and developing the electrostatic latent image formed on the image carrier. The developing power source applies a predetermined developing bias voltage to the developing device. The current measuring device measures a developing current flowing in the developing device. The calculation device calculates a surface potential of the image carrier, on a basis of the developing current measured by the current measuring device.

BRIEF DESCRIPTION OF THE DRAWINGS

FIG. 7 is a table showing the developing current, measured when four levels of developing bias voltages are applied to a developing roller for one second, in the image forming apparatus 1 according to a working example;

FIG. 12 is a table showing the developing current, measured when four levels of charging biases are applied to a photoconductor drum, in the image forming apparatus 1 according to the working example;

FIG. 17 is a table showing the developing current, measured when the rotation speed t was set to 280 [mm/sec], and four levels of developing bias voltages were applied to the developing roller, in the image forming apparatus 1 according to the working example;

FIG. 19 is a table showing the surface potential, calculated when four levels of rotation speed t were set, in the image forming apparatus 1 according to the working example;

FIG. 21 is a table showing the surface potential, calculated when three levels of rotation speed t, different from FIG. 19 and FIG. 20, were set in the image forming apparatus 1 according to the working example.

DETAILED DESCRIPTION

Figure 1:
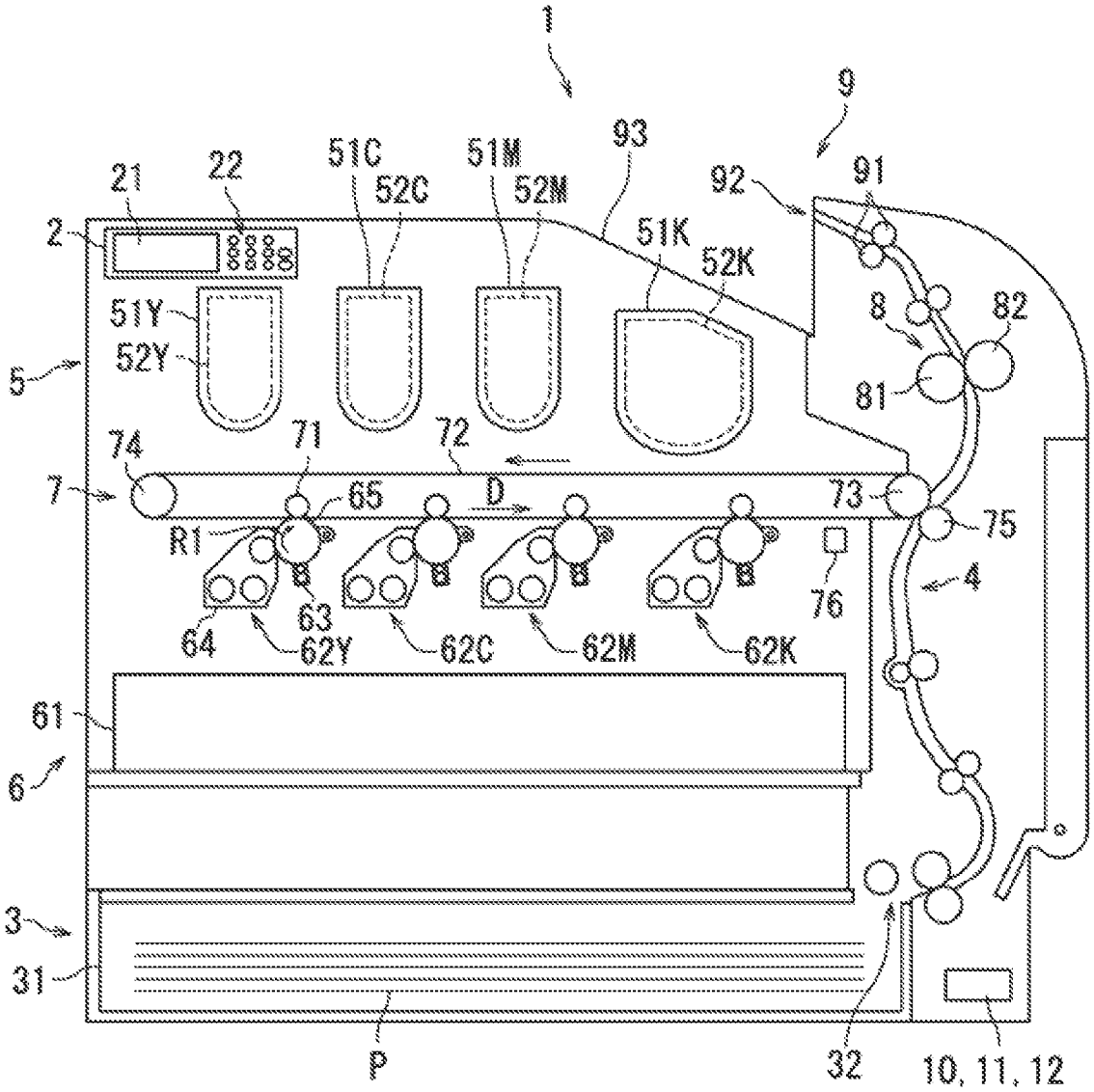
FIG. 1 is a schematic cross-sectional view showing a configuration of an image forming apparatus.

Hereafter, an image forming apparatus according to some embodiments of the disclosure will be described, with reference to the drawings. In the drawings, the same or corresponding elements are given the same numeral, and the description thereof will not be repeated.

Referring to FIG. 1, a configuration of an image forming apparatus 1 according to the embodiment of the disclosure will be described. FIG. 1 is a schematic cross-sectional view showing the configuration of the image forming apparatus 1. The image forming apparatus 1 is, for example, a tandem-type color printer.

As shown in FIG. 1, the image forming apparatus 1 includes an operation device 2, a paper feeding device 3, a transport mechanism 4, a toner supply device 5, an image forming device 6, a transfer device 7, a fixing device 8, a discharge device 9, and a control device 10.

The operation device 2 instructions from a user. Upon receipt of the instruction from the user, the operation device 2 transmits a signal indicating the user's instruction to the control device 10. The operation device 2 includes a liquid crystal display (LCD) 21 and a plurality of operation keys 22. The LCD 21 displays, for example, results of various types of processings. The operation keys 22 include, for example, a tenkey and a start key. When an instruction to execute an image forming operation is inputted, the operation device 2 transmits a signal for executing the image forming operation, to the control device 10. As result, the image forming apparatus 1 starts up the image forming operation.

The paper feeding device 3 includes a paper cassette 31, and a group of paper feeding rollers 32. The paper cassette 31 is configured to store therein a plurality of sheets P The paper feeding roller group 32 serves to deliver the sheets P stored in the paper cassette 31, one by one to the transport mechanism 4.

The transport mechanism 4 includes a roller and a guide member. The transport mechanism 4 extends from the paper feeding device 3 as far as the discharge device 9. The transport mechanism 4 transports the sheets P, from the paper feeding device 3 to the discharge device 9, through the image forming device 6 and the fixing device 8.

The toner supply device 5 supplies toner to the image forming device 6. The toner supply device 5 includes a first mounting base 51Y, a second mounting base 51C, a third mounting base 51M, and a fourth mounting base 51K.

On the first mounting base 51Y, a first toner container 52Y is mounted. Likewise, a second toner container 52C is mounted on the second mounting base 51C, a third toner container 52M is mounted on the third mounting base 51M, and a fourth toner container 52K is mounted on the fourth mounting base 51K. The configuration of the first mounting base 51Y to the fourth mounting base 51K is common to all the mounting bases, except for the difference in type of the toner container to be mounted. Accordingly, the first mounting base 51Y to the fourth mounting base 51K may be collectively referred to as "mounting base 51".

In each of the first toner container 52Y, the second toner container 52C, the third toner container 52M, and the fourth toner container 52K, the toner is stored. In this embodiment, yellow toner is stored in the first toner container 52Y. Cyan toner is stored in the second toner container 52C. Magenta toner is stored in the third toner container 52M. Black toner is stored in the fourth toner container 52K.

The image forming device 6 includes an exposure device 61, a first image forming unit 62Y, a second image forming unit 62C, a third image forming unit 62M, and a fourth image forming unit 62K.

The first image forming unit 62Y to the fourth image forming unit 62K each include a charging device 63, a developing device 64, and a photoconductor drum 65. The photoconductor drum 65 exemplifies the image carrier in the disclosure.

The charging device 63 and the developing device 64 are located along the circumferential surface of the photoconductor drum 65. In this embodiment, the photoconductor drum 65 rotates in a direction indicated by an arrow R1 in FIG. 1, namely clockwise.

The charging device 63 discharges electricity, thereby uniformly charging the photoconductor drum 65 to a predetermined polarity. In this embodiment, the charging device 63 charges the photoconductor drum 65 to the positive polarity. The exposure device 61 irradiates the charged photoconductor drum 65 with a laser beam. Accordingly, an electrostatic latent image is formed on the surface of the photoconductor drum 65.

The developing device 64 develops the electrostatic latent image formed on the surface of the photoconductor drum 65, thereby forming a toner image. To the developing device 64, the toner is supplied from the toner supply device 5. The developing device 64 applies the toner supplied from the toner supply device 5 to the surface of the photoconductor drum 65. As result, the toner image is formed on the surface of the photoconductor drum 65.

In this embodiment, the developing device 64 in the first image forming unit 62Y is connected to the first mounting base 51Y. Therefore, the yellow toner is supplied to the developing device 64 in the first image forming unit 62Y. Accordingly, a yellow toner image is formed on the surface of the photoconductor drum 65 in the first image forming unit 62Y.

The developing device 64 in the second image forming unit 62C is connected to the second mounting base 51C. Therefore, the cyan toner is supplied to the developing device 64 in the second image forming unit 62C. Accordingly, a cyan toner image is formed on the surface of the photoconductor drum 65 in the second image forming unit 62C.

The developing device 64 in the third image forming unit 62M is connected to the third mounting base 51M. Therefore, the magenta toner is supplied to the developing device 64 in the third image forming unit 62M. Accordingly, a magenta toner image is formed on the surface of the photoconductor drum 65 in the third image forming unit 62M.

The developing device 64 in the fourth image forming unit 62K is connected to the fourth mounting base 51K. Therefore, the black toner is supplied to the developing device 64 in the fourth image forming unit 62K. Accordingly, a black toner image is formed on the surface of the photoconductor drum 65 in the fourth image forming unit 62K.

The transfer device 7 superposes the toner images formed on the respective photoconductor drums 65 of the first image forming unit 62Y to the fourth image forming unit 62K, on the sheet P, thereby transferring the toner images thereto. In this embodiment, the transfer device 7 superposes and transfers the toner images through a secondary transfer process, onto the sheet P To be more detailed, the transfer device 7 includes four primary transfer rollers 71, an intermediate transfer belt 72, a drive roller 73, a follower roller 74, a secondary transfer roller 75, and a density sensor 76.

The intermediate transfer belt 72 is an endless belt stretched over the four primary transfer rollers 71, the drive roller 73, and the follower roller 74. The intermediate transfer belt 72 is driven by the rotation of the drive roller 73. In FIG. 1, the intermediate transfer belt 72 rotates counterclockwise. The follower roller 74 is made to rotate by the rotation of the intermediate transfer belt 72.

The first image forming unit 62Y to the fourth image forming unit 62K are aligned along the moving direction D of the lower surface of the intermediate transfer belt 72, and each opposed thereto. In this embodiment, the first image forming unit 62Y to the fourth image forming unit 62K are aligned in this order from the upstream side toward the downstream side, along the moving direction D of the lower surface of the intermediate transfer belt 72.

The primary transfer rollers 71 are respectively opposed to, and pressed against, the photoconductor drums 65 via the intermediate transfer belt 72. Accordingly, the toner images formed on the respective photoconductor drums 65 are sequentially transferred to the intermediate transfer belt 72. In this embodiment, the yellow toner image, the cyan toner image, the magenta toner image, and the black toner image are superposed and transferred in this order, to the intermediate transfer belt 72. Hereinafter, the toner image formed by superposing the yellow toner image, the cyan toner image, the magenta toner image, and the black toner image may be referred to as "layered toner image", where appropriate.

The secondary transfer roller 75 is opposed to the drive roller 73, via the intermediate transfer belt 72. The secondary transfer roller 75 is pressed against the drive roller 73. Accordingly, a transfer nip is defined between the secondary transfer roller 75 and the drive roller 73. When the sheet P passes through the transfer nip, the layered toner image on the intermediate transfer belt 72 is transferred to the sheet P In this embodiment, the yellow toner image, the cyan toner image, the magenta toner image, and the black toner image are transferred to the sheet P, such that the toner images are layered in the mentioned order, from the upper layer to the lower layer. The sheet P to which the layered toner image has been transferred is transported toward the fixing device 8, by the transport mechanism 4.

The density sensor 76 is opposed to the intermediate transfer belt 72, at a position downstream of the first image forming unit 62Y to the fourth image forming unit 62K, and measures the density of the layered toner image formed on the intermediate transfer belt 72. Here, the density sensor 76 may measure the density of the toner image on the photoconductor drum 65, or the density of the toner image fixed to the sheet P.

The fixing device 8 includes a heater 81 and a presser 82. The heater 81 and the presser 82 are opposed to each other, so as to define a fixing nip. The sheet P transported from the image forming device 6 is heated at a predetermined temperature and pressed, while passing through the fixing nip. As result, the layered toner image is fixed to the sheet P The sheet P is transported by the transport mechanism 4, from the fixing device 8 toward the discharge device 9.

The discharge device 9 includes a discharge roller pair 91 and an output tray 93. The discharge roller pair 91 transports the sheet P toward the output tray 93, through the discharge port 92. The discharge port 92 is located at an upper position of the image forming apparatus 1.

The control device 10 controls the operation of the components provided in the image forming apparatus 1. The control device 10 includes a processor 11 and a storage device 12. The processor 11 includes, for example, a central processing unit (CPU). The storage device 12 includes a memory such as a semiconductor memory, and may also include a hard disk drive (HDD). The storage device 12 contains a control program. The processor 11 controls the operation of the image forming apparatus 1, by executing the control program.

Figure 2:
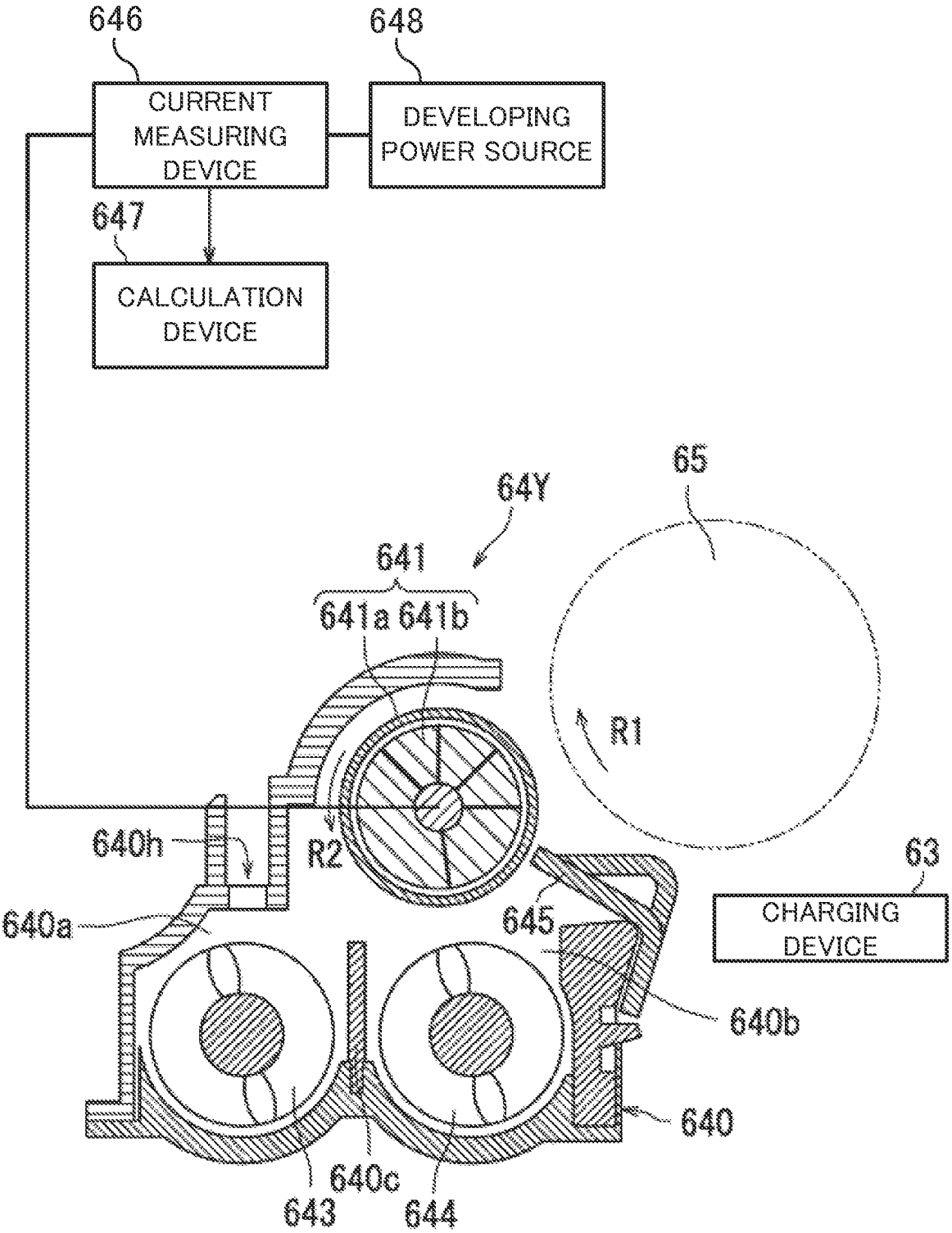
FIG. 2 is a schematic cross-sectional view showing a configuration of a developing device.

Referring to FIG. 2, a configuration of the developing device 64 will be described hereunder. FIG. 2 illustrates an example of the configuration of the developing device 64. More specifically, FIG. 2 illustrates the first developing device 64Y in the first image forming unit 62Y. For the sake of clarity, the photoconductor drum 65 is indicated by dash-dot-dot lines in FIG. 2. In this embodiment, the first developing device 64Y develops the electrostatic latent image formed on the surface of the photoconductor drum 65, through a two-component developing process. As described above with reference to FIG. 1, the developing container 640 of the first developing device 64Y is connected to the first toner container 52Y. Therefore, the yellow toner is supplied to the developing container 640 of the first developing device 64Y, through a toner inlet 640*h*.

As shown in FIG. 2, the first developing device 64Y includes a developing roller 641, a first stirring screw 643, a second stirring screw 644, and a blade 645, located inside the developing container 640. To be more detailed, the developing roller 641 is opposed to the second stirring screw 644. The blade 645 is opposed to the developing roller 641.

The developing container 640 is divided into a first mixing chamber 640*a* and a second mixing chamber 640*b*, by a partition wall 640*c*. The partition wall 640*c* extends in the axial direction of the developing roller 641. The first mixing chamber 640*a* and the second mixing chamber 640*b* communicate with each other, on the outer side of the respective ends of the partition wall 640*c* in the longitudinal direction.

The first stirring screw 643 is provided in the first mixing chamber 640*a*. In addition, a magnetic carrier is stored in the first mixing chamber 640*a*. To the first mixing chamber 640*a*, a non-magnetic toner is supplied through the toner inlet 640*h*. In the example shown in FIG. 2, the yellow toner is supplied to the first mixing chamber 640*a*.

The second stirring screw 644 is provided in the second mixing chamber 640*b*. In addition, a magnetic carrier is stored in the second mixing chamber 640*b*.

The yellow toner is stirred by the first stirring screw 643 and the second stirring screw 644, thus to be mixed with the carrier. As result, a two-component developing agent, composed of the carrier and the yellow toner, is formed. Since the two-component developing agent is an example of the developing agent, the two-component developing agent may hereinafter be simply referred to as "developing agent", where appropriate.

The first stirring screw 643 and the second stirring screw 644 stir the developing agent, while circulating the developing agent between the first mixing chamber 640*a* and the second mixing chamber 640*b*. As result, the toner is charged to a predetermined polarity. In this embodiment, the toner is charged to the positive polarity.

The developing roller 641 is composed of a non-magnetic rotary sleeve 641*a* and a magnetic body 641*b*. The magnetic body 641*b* is fixed inside the rotary sleeve 641*a*. The magnetic body 641*b* includes a plurality of magnetic poles. The developing agent adsorbs to the developing roller 641, because of the magnetic force of the magnetic body 641*b*. As result, a magnetic brush is formed on the surface of the developing roller 641.

In this embodiment, the developing roller 641 rotates in the direction indicated by an arrow R2 in FIG. 2, namely counterclockwise. The developing roller 641 transports, by rotating, the magnetic brush to the position opposite the blade 645. The blade 645 is located so as to define a gap between itself and the developing roller 641. Accordingly, the thickness of the magnetic brush is defined by the blade 645. The blade 645 is located on the upstream side in the rotating direction of the developing roller 641, with respect to the position where the developing roller 641 and the photoconductor drum 65 are opposed to each other.

A predetermined voltage is applied to the developing roller 641. Accordingly, the developing agent layer formed on the surface is transported to the position opposite the photoconductor drum 65, and the toner in the developing agent is adhered to the photoconductor drum 65.

More specifically, the first developing device 64Y further includes a current measuring device 646, a calculation device 647, and a developing power source 648.

The current measuring device 646 is, for example, connected between the developing power source 648 and the developing roller 641. The developing power source 648 applies a predetermined developing bias voltage, to the developing roller 641 of the first developing device 64Y. The current measuring device 646 detects a current flowing between the first developing device 64Y and the photoconductor drum 65, and the developing roller 641, according to the developing bias voltage applied by the developing power source 648. The current measuring device 646 includes, for example, an ammeter, to measure the current value of the developing current.

Figure 3A:
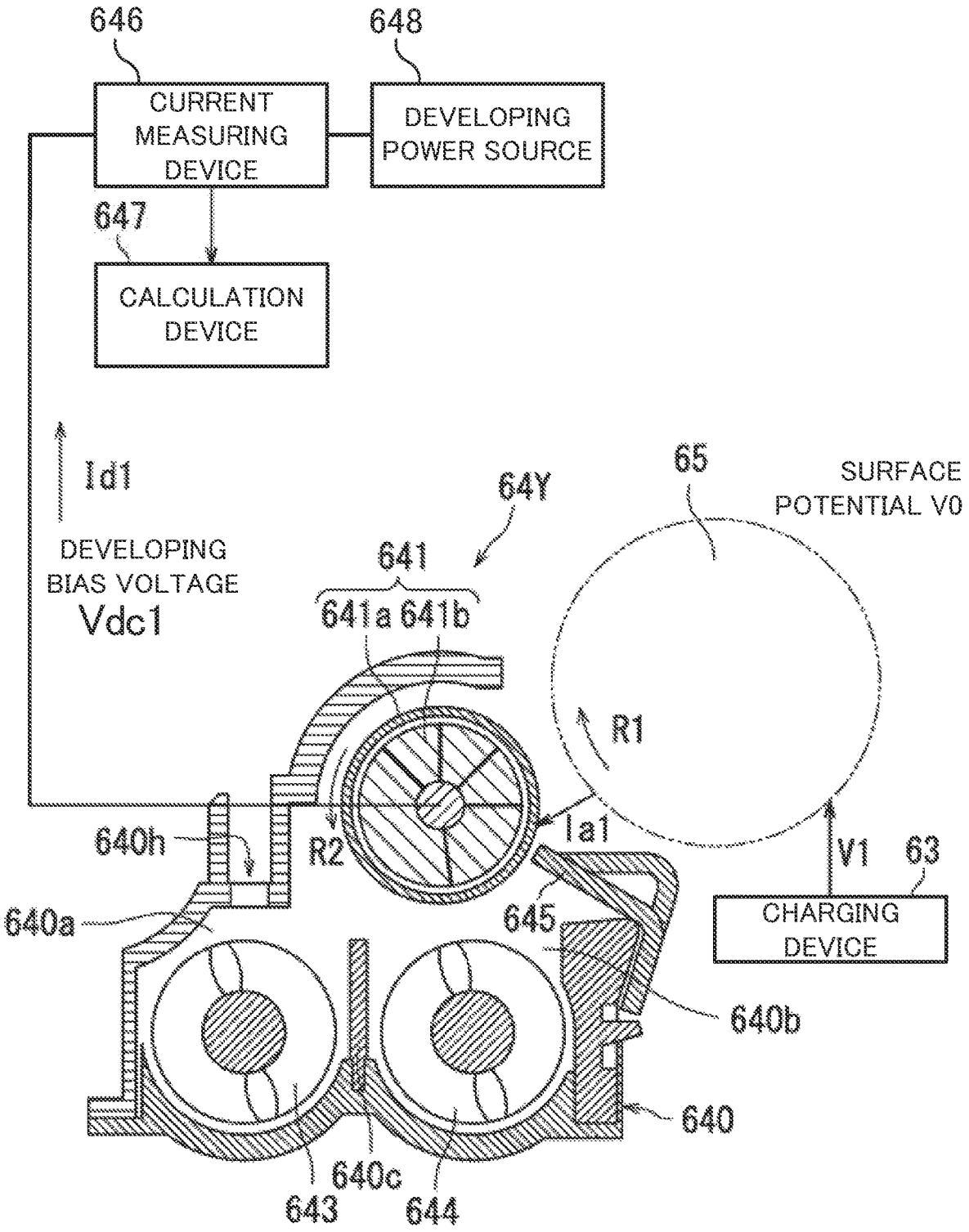
FIG. 3A is a schematic cross-sectional view for explaining a developing current measured by a current measuring device.
Figure 3B:
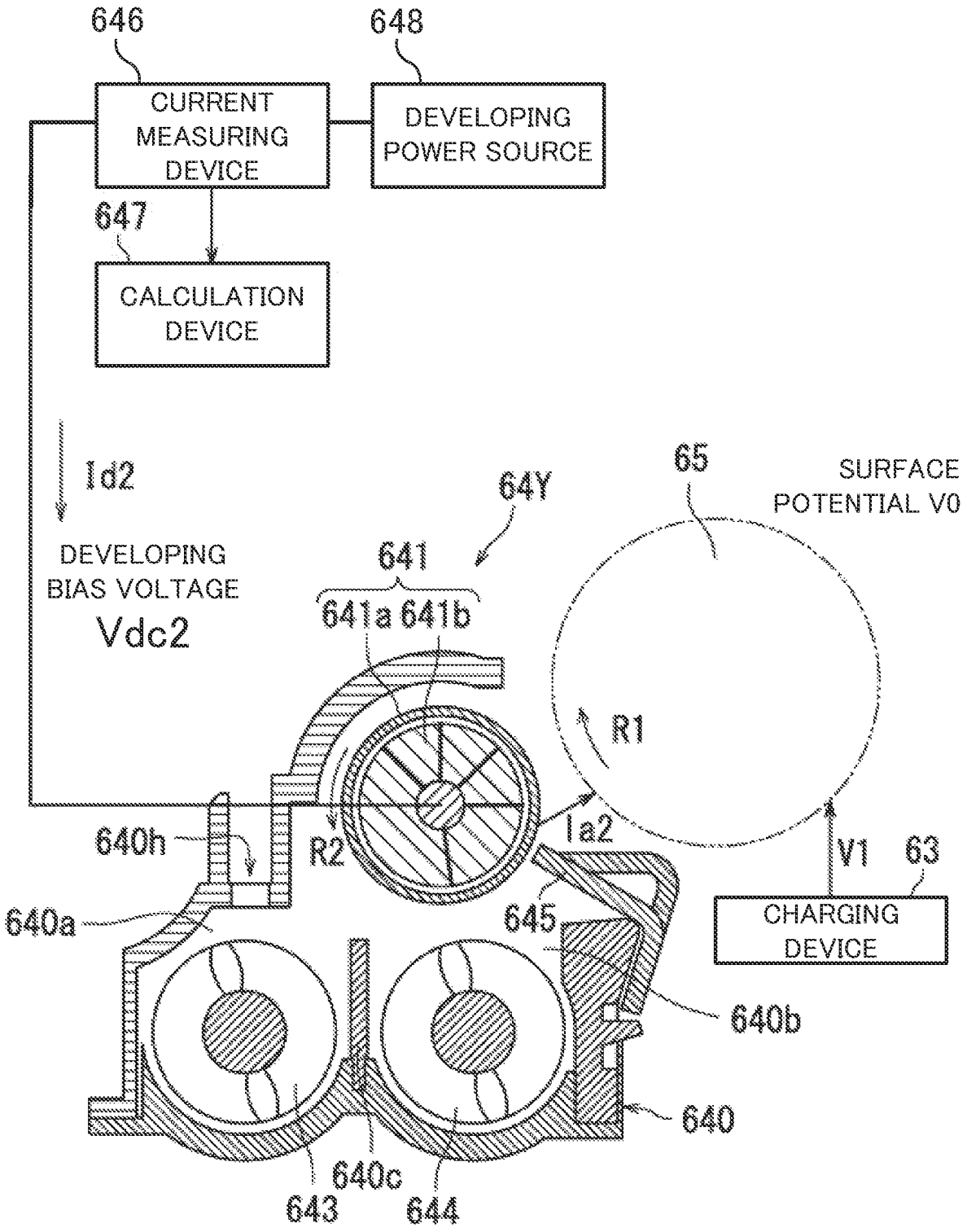
FIG. 3B is a schematic cross-sectional view for explaining the developing current measured by the current measuring device.

Referring now to FIG. 3A and FIG. 3B, the developing current flowing in the first developing device 64Y will be described hereunder. FIG. 3A and FIG. 3B are schematic cross-sectional views for explaining the developing current measured by the current measuring device 646.

For example, the current measuring device 646 measures the current value of the developing current, flowing while the first developing device 64Y is developing the electrostatic latent image formed on the photoconductor drum 65.

In this embodiment, when the instruction to execute the image forming operation is inputted by the user to the image forming apparatus 1, the control device 10 controls the image forming device 6 so as to cause the components of the image forming apparatus 1 to start the image forming operation. More specifically, the control device 10 controls the charging device 63, the first developing device 64Y, the developing power source 648, and the exposure device 61.

The charging device 63 charges, under the control by the control device 10, the surface of the photoconductor drum 65 to a predetermined charge potential (surface potential V0). To be more detailed, when the charging device 63 applies a charging bias to the photoconductor drum 65, the surface of the photoconductor drum 65 is charged to the surface potential V0.

The developing power source 648 applies a developing bias voltage to the developing roller 641, under the control by the control device 10. The developing bias voltage contains a DC component and an AC component. FIG. 3A represents the case where a developing bias voltage, in which the DC component (Vdc1) is smaller than the surface potential V0, is applied to the developing roller 641. Here, it is not mandatory that the developing bias voltage contains an AC component.

The exposure device 61 irradiates, under the control by the control device 10, the photoconductor drum 65 charged by the charging device 63 to the surface potential V0, with a laser beam. As result, the electrostatic latent image is formed on the surface of the photoconductor drum 65.

When the electrostatic latent image is formed on the surface of the photoconductor drum 65, the first developing device 64Y develops the electrostatic latent image formed on the surface of the photoconductor drum 65, under the control by the control device 10.

At this point, the current measuring device 646 measures the current value of the developing current. Referring to FIG. 3A, the developing current Id1 is the sum of a current flowing when the toner in the magnetic brush formed on the developing roller 641 migrates to the photoconductor drum 65, and a current Ia1 flowing from the photoconductor drum 65 through the magnetic brush formed on the developing roller 641.

FIG. 3B represents the case where a developing bias voltage, in which the DC component (Vdc2) is larger than the surface potential V0, is applied to the developing roller 641. Referring to FIG. 3B, the developing current Id2 is the sum of a current Ia2 flowing when the toner is developed on the photoconductor drum 65, and a current flowing to the photoconductor drum 65 through the magnetic brush formed on the developing roller 641.

As described above, the developing current measured by the current measuring device 646 is flows in opposite directions, between the cases where the DC component of the developing bias voltage is larger than the surface potential V0, and where the DC component of the developing bias voltage is smaller than the surface potential V0.

In addition, when the DC component of the bias voltage is equal to the surface potential V0, the developing electric field intensity becomes zero, and the developing current is measured as zero. Therefore, it can be predicted that the DC component of the developing bias voltage that makes the developing current zero corresponds to the surface potential V0.

Figure 4:
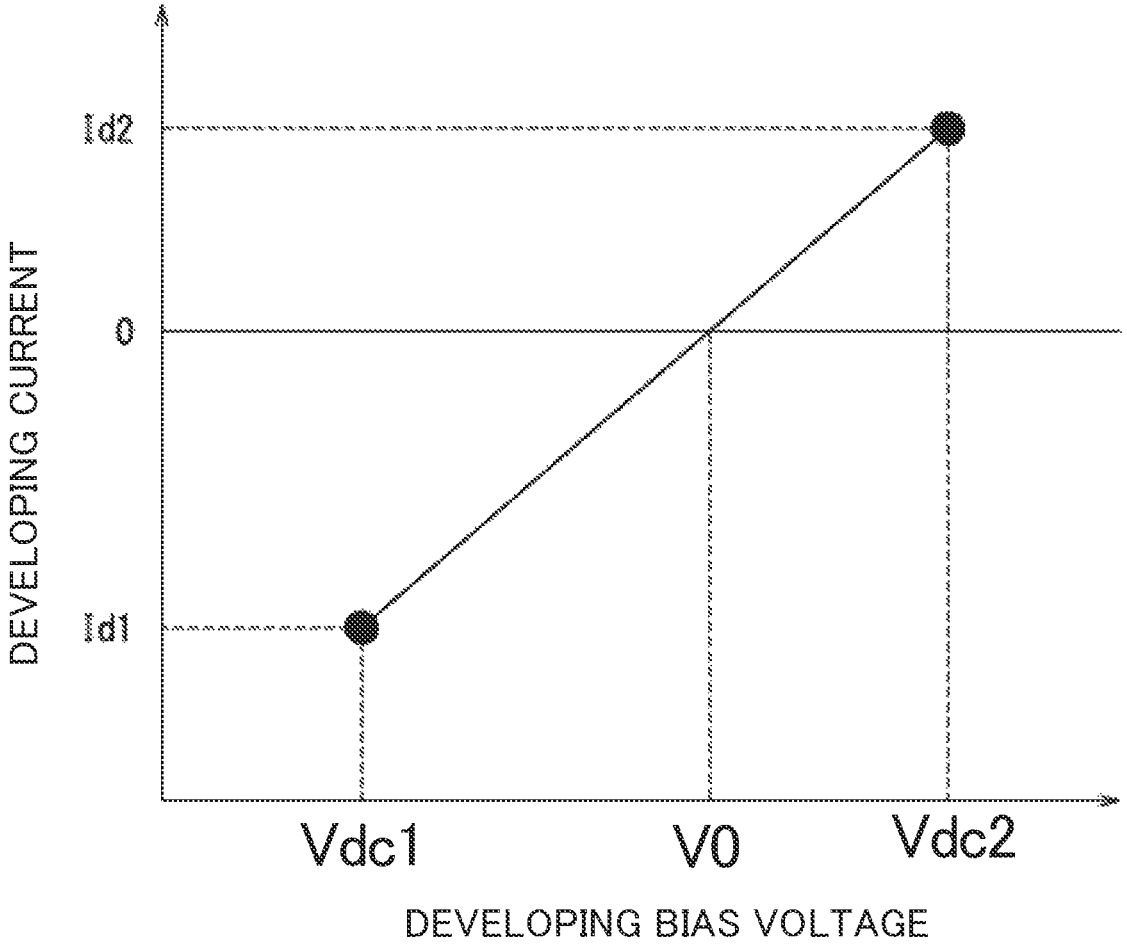
FIG. 4 is a graph showing a relation between the developing current and a developing bias voltage.

Hereunder, the calculation of the surface potential will be described, with reference to FIG. 3A to FIG. 4. FIG. 4 is a graph showing a relation between the developing current and the developing bias voltage. In FIG. 4, the vertical axis represents the developing current, and the horizontal axis represents the developing bias voltage.

For example, when the developing power source 648 applies the developing bias voltage Vdc1 to the developing roller 641, the current measuring device 646 measures the current value of the developing current Id1. The calculation device 647 acquires the developing bias voltage Vdc1 applied by the developing power source 648, and the current value of the developing current Id1 measured by the current measuring device 646 (FIG. 3A).

When the developing power source 648 applies the developing bias voltage Vdc2 to the developing roller 641, the current measuring device 646 measures the current value of the developing current Id2. The calculation device 647 acquires the developing bias voltage Vdc2 applied by the developing power source 648, and the current value of the developing current Id2 measured by the current measuring device 646 (FIG. 3B).

The calculation device 647 calculates the developing bias voltage that cancels the flow of the developing current, as the surface potential V0, on the basis of the developing bias voltage Vdc1 and the developing current Id1, and the developing bias voltage Vdc2 and the developing current Id2, acquired as above.

In this embodiment, the developing devices 64 respectively included in the first image forming unit 62Y to the fourth image forming unit 62K have generally the same configurations, except for the difference in type of the toner supplied from the toner supply device 5. Accordingly, the description about the second developing device 64C to the fourth developing device 64K, respectively included in the second image forming unit 62C to the fourth image forming unit 62K, will be skipped.

For example, the control device 10 determines the developing bias voltage Vdc to be applied by the developing power source 648 to the developing roller 641, according to the surface potential V0 calculated by the calculation device 647.

With the mentioned arrangement, a developing bias voltage having an appropriate potential difference can be applied to the developing roller 641, in the developing process of the electrostatic latent image, and therefore an image of a higher quality can be obtained.

The calculation of the surface potential is performed, for example, after the instruction to execute the image forming operation is inputted by the user to the image forming apparatus 1, and before the control device 10 controls the image forming device 6 so as to start the image forming operation.

For example, it has been found that, when the condition of toner concentration changes between the developing roller 641 and the photoconductor drum 65 (i.e., developing nip), in the intervals between the application of the developing bias voltages of a plurality of levels to the developing roller 641, in a calculation process of the surface potential, the developing current to be measured also changes owing to the change in condition of the toner concentration, which leads to inaccurate calculation of the surface potential.

For example, when the developing bias voltage Vdc1 smaller than the surface potential V0 is applied to the developing roller 641 as shown in FIG. 3A, the amount of the toner stuck to the developing roller 641 is increased, and therefore the developing bias voltage is decided to be larger than the actual value, owing to the charge potential of the toner stuck to the developing roller 641.

In contrast, when the developing bias voltage Vdc2 larger than the surface potential V0 is applied to the developing roller 641 as shown in FIG. 3B, the toner migrates from the developing roller 641 to the photoconductor drum 65, and therefore the toner concentration at the developing nip is lowered.

To avoid such phenomena, the cleaning bias voltage is applied to the developing roller 641, before each of the developing bias voltages is applied to the developing roller 641, in this embodiment. Applying thus the cleaning bias voltage allows the condition of the developing nip to be adjusted before each application of the developing bias voltage, thereby minimizing the impact of the change in condition of the developing nip.

Figure 5:
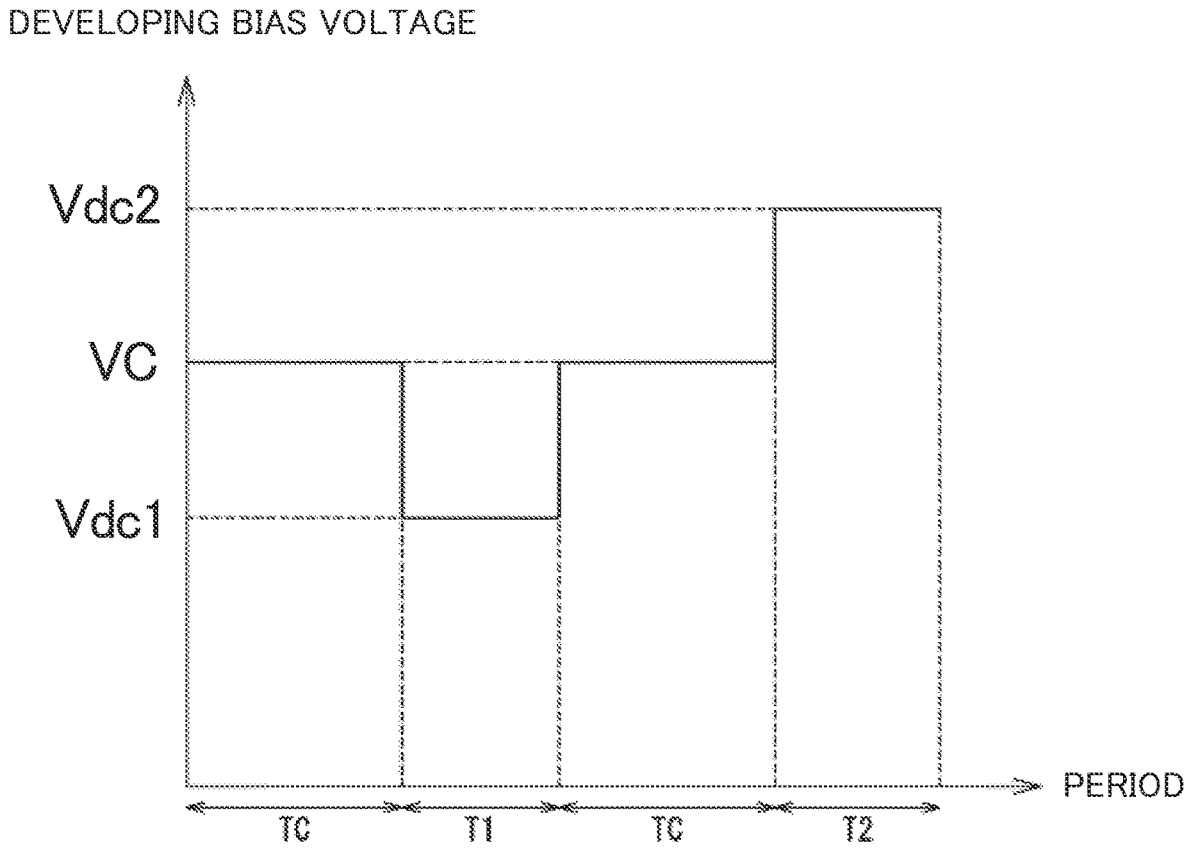
FIG. 5 is a graph showing a relation between the developing bias voltage and an application time.

Referring to FIG. 3A to FIG. 5, the cleaning bias voltage will be described hereunder. FIG. 5 is a graph showing a relation between the developing bias voltage and an application time. In FIG. 5, the vertical axis represents the developing bias voltage, and the horizontal axis represents the application time (period).

FIG. 5 shows, for the sake of simplicity, the case where the surface potential is calculated by applying the developing bias voltages Vdc1 and Vdc2 to the developing roller 641. In this embodiment, a larger number of developing bias voltages than the developing bias voltages Vdc1 and Vdc2 may be applied to the developing roller 641, to calculate the surface potential. In this case, the cleaning bias voltage is applied before each of the developing bias voltages is applied.

In this embodiment, the developing power source 648 applies, under the control of the controller 10, the cleaning bias voltage VC to the developing roller 641 before applying the developing bias voltage Vdc1, when the surface potential is to be calculated.

The cleaning bias voltage VC is, for example, in a range between a minimum value and a maximum value, both ends inclusive, among the developing bias voltages of a plurality of levels. In the example shown in FIG. 5, the cleaning bias voltage VC is equal to or larger than the developing bias voltage Vdc1, and equal to or smaller than the developing bias voltage Vdc2.

For example, the cleaning bias voltage VC is determined by the controller 10, on the basis of the developing bias voltage applied in the immediately preceding image forming operation, the charging bias applied by the charging device 63, and the measurement result from the density sensor 76. Typically, the cleaning bias voltage VC is determined so as to be an intermediate value between the developing bias voltage Vdc1 and the developing bias voltage Vdc2.

Here, the AC component in the cleaning bias voltage VC, and the charging bias, applied when the cleaning bias voltage VC is applied, may be different between the applications of the developing bias voltages Vdc1 and Vdc2.

In addition, the period TC during which the cleaning bias voltage VC is applied is longer than the period in which the developing roller 641 makes one rotation. Such a setting suppresses a difference in condition of the developing nip, arising from a difference in position of the developing roller 641 along the rotation direction.

The period TC is determined by the controller 10, on the basis of the toner concentration and the toner charge amount inside the developing container 640.

To be more detailed, the controller 10 acquires a toner concentration C of the developing agent in the developing container 640, detected by a non-illustrated sensor provided in the developing container 640. The controller 10 also acquires the measurement result from the density sensor 76 and the developing current measured by the current measurement device 646, and calculates, as a toner charge amount Q, a ratio of a toner use amount converted from the measurement result from the density sensor 76, to the developing charge amount obtained through temporal integration of the developing current.

For example, when the toner concentration in the developing container 640 is higher, the toner is encouraged to migrate through the developing nip, by which the developing bias voltage and the developing current are affected. When the toner charge amount is lower, the toner is encouraged to migrate through the developing nip, by which the developing bias voltage and the developing current are affected.

The controller 10 calculates the period TC, for example with the following equation (1).

$$TC[\text{sec}] = 0.1 \times C - 0.01 \times Q + 1 \quad (1)$$

Here, the controller 10 may apply the cleaning bias voltage VC for a period longer than the period TC calculated with the equation (1). The longer the application time of the cleaning bias voltage VC is, the smaller the impact of the developing bias voltage, previously applied to the developing roller 641, can be made.

To the developing roller 641, the developing bias voltage Vdc1 is applied for a period T1 [sec], after the cleaning bias voltage VC is applied for the period TC [sec]. The period T1 [sec] is, for example, a time sufficient for the current measurement device 646 to measure the developing current Id1.

Thereafter, the cleaning bias voltage VC is applied to the developing roller 641 period TC [sec], and the developing bias voltage Vdc2 is applied thereto for a period T2 [sec].

The calculation device 647 acquires the developing bias voltage Vdc1 and the developing current Id1, and also the developing bias voltage Vdc2 and the developing current Id2, and calculates the surface potential V0.

The period TC may be determined on the basis of an advection diffusion coefficient of the developing agent, and the magnitude and frequency of the AC component of the developing bias voltage. For example, when the advection diffusion coefficient of the developing agent is determined in advance, the time for the supplied toner to reach the developing nip can be known, from the amount and timing of the toner supply to the developing container 640. Therefore, the toner concentration at the developing nip can be obtained more accurately.

Further, when the AC component of the developing bias voltage is large, or has a high frequency, the toner is encouraged to migrate, which leads to an increase in amount of the toner stuck to the developing roller 641.

Applying thus the cleaning bias voltage VC, so as to adjust the condition of the developing nip before the application of each developing bias voltage, enables the surface potential of the photoconductor drum 65 to be acquired with high accuracy.

Figure 6:
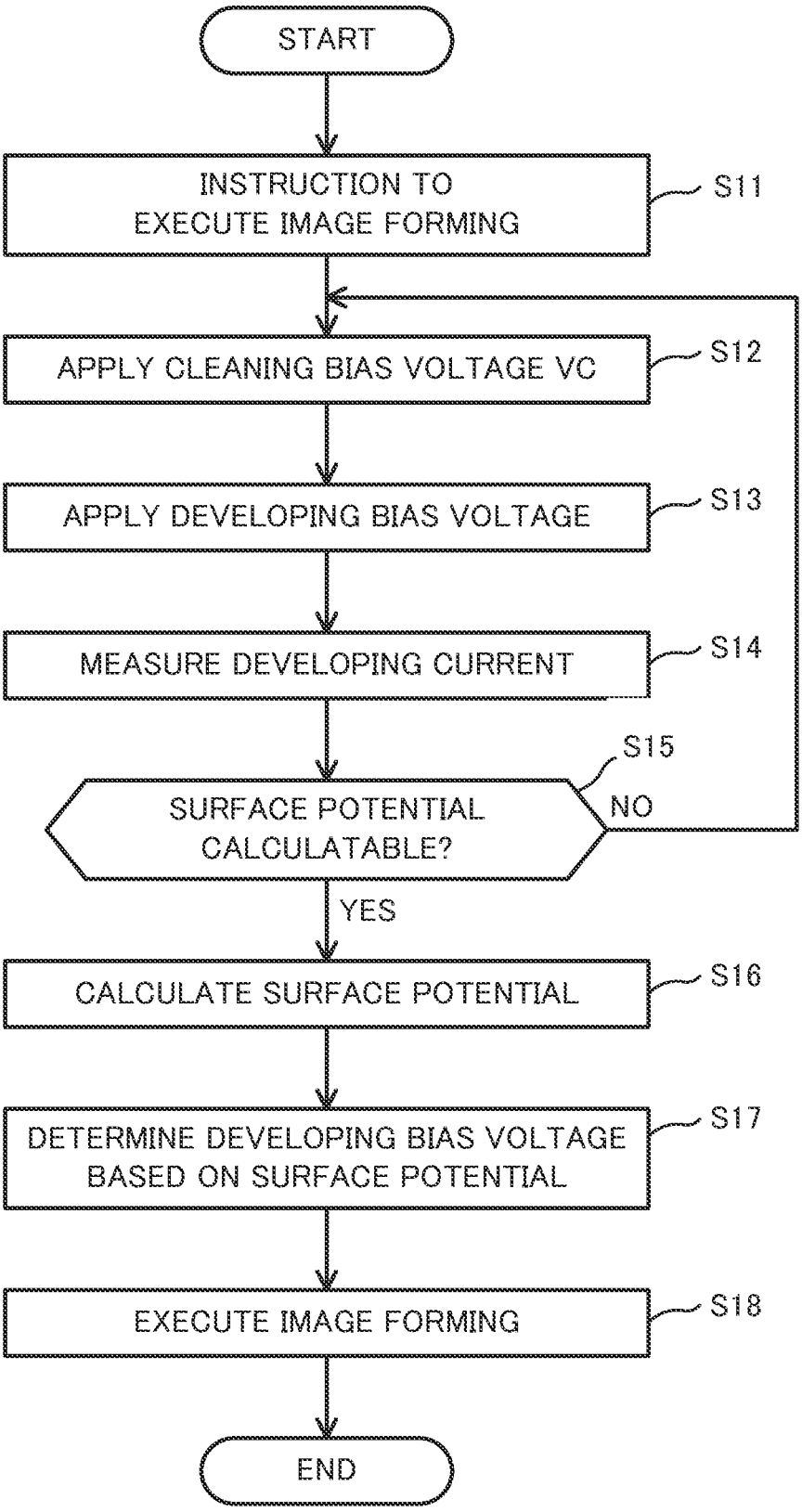
FIG. 6 is a flowchart showing a surface potential calculation process according to an embodiment.

Hereunder, the surface potential calculation process according to this embodiment will be described, with reference to FIG. 6. FIG. 6 is a flowchart showing the surface potential calculation process according to this embodiment.

When the user inputs an instruction to execute the image forming operation to the image forming apparatus 1 (step S11), the controller 10 causes the developing power source 648 to apply a cleaning bias voltage VC to the developing roller 641 (step S12).

After the period TC [sec] has elapsed, the controller 10 causes the developing power source 648 to apply a predetermined developing bias voltage to the developing roller 641 (step S13). The current measurement device 646 measures the developing current (step S14).

The controller 10 decides whether the calculation device 647 can calculate the surface potential (step S15). In the case where a sufficient amount of developing current has not been measured, for the calculation of the surface potential by the calculation device 647 (No at step S15), the controller 10 causes the developing power source 648 to apply the cleaning bias voltage VC to the developing roller 641 (step S12), and then apply a different developing bias voltage to the developing roller 641 (step S13).

In contrast, when a sufficient amount of developing current has been measured, for the calculation of the surface potential by the calculation device 647 (Yes at step S15), the controller 10 causes the calculation device 647 to calculate the surface potential (step S16).

The controller 10 determines the bias voltage to be applied to the developing roller 641 for the image forming operation, on the basis of the surface potential calculated by the calculation device 647 (step S17), and executes the image forming operation (step S18).

In this embodiment, the surface potential may be calculated after or during the image forming operation, without limitation to before the image forming operation. In addition, only the calculation of the surface potential may be performed, without executing the image forming operation, according to an instruction inputted by the user.

Working Example 1

Hereunder, the disclosure will be described in detail with reference to a working example. However, the disclosure is not limited to the following working example.

For the working example based on the disclosure, a multifunction peripheral was employed as the image forming apparatus 1. The multifunction peripheral was a modified model of TASKalfa2550Ci, from Kyosera Document Solutions Inc.

The experiment conditions of the multifunction peripheral were as specified below.

- Photoconductor drum 65: Amorphous silicon (a-Si) drum
- Film thickness of photoconductor drum 65: 20 μm
- Charging device 63: Outer diameter of core of charging roller 6 mm, rubber thickness 3 mm, rubber resistance 6.0 LogΩ
- Charge bias voltage: DC 350V, AC 1000V, frequency 3 kHz (common to developing bias voltage application and cleaning developing bias voltage application)
- Blade 645: SUS430, Magnetic
- Thickness of blade 645: 1.5 mm
- Surface of developing roller 641: Knurled and blasted
- Outer diameter of developing roller 641: 20 mm
- Recess of developing roller 641: Circumferentially 80 rows
- Ratio of circumferential speed of developing roller 641 to circumferential speed of photoconductor drum 65: 1.8
- Distance between developing roller 641 and photoconductor drum 65: 0.30 mm
- AC component of developing bias voltage: Vpp 1200V, duty 50%, square wave, 8 kHz
- Toner: Particle diameter 6.8 μm, positively charged
- Carrier: Particle diameter 38 μm, resin-coated ferrite carrier
- Toner concentration: 6%
- Printing speed: 55 sheets/min.
- Cleaning developing bias voltage: 270V
- Application time of cleaning developing bias voltage: Calculated from equation (1) TC [sec]=0.1×C−0.01×Q+1 (when TC [sec] is shorter than one second, TC [sec] was regarded as 1)

Figure 8:
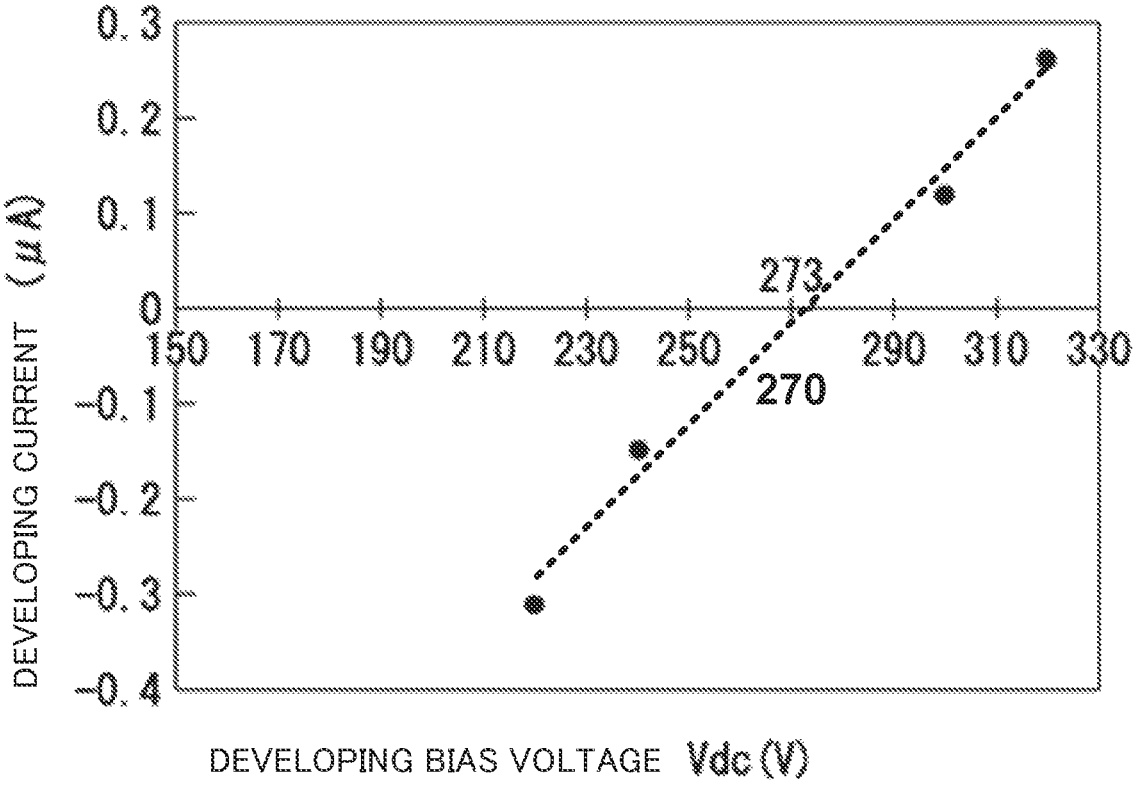
FIG. 8 is a graph showing the relation between the developing bias voltage and the developing current, shown in FIG. 7.

Referring to FIG. 7 and FIG. 8, the surface potential calculated by the image forming apparatus 1 according to this working example will be described hereunder.

FIG. 7 is a table showing the developing current, measured when four levels of developing bias voltages were applied to the developing roller 641 for one second, in the image forming apparatus 1 according to this working example.

FIG. 8 is a graph showing the relation between the developing bias voltage and the average developing current, shown in FIG. 7. In FIG. 8, the vertical axis represents the developing current, and the horizontal axis represents the developing bias voltage.

In this working example, when the developing bias voltage of 220 [V] was applied, the measured developing current was −0.31 [μA]. When the developing bias voltage of 240 [V] was applied, the measured developing current was −0.15 [μA]. When the developing bias voltage of 300 [V] was applied, the measured developing current was 0.12 [μA]. When the developing bias voltage of 320 [V] was applied, the measured developing current was 0.26 [μA].

As shown in FIG. 8, the surface potential was calculated as 273 [V], in the image forming apparatus 1 according to this working example.

Although the difference in developing bias voltages to be applied was set to 100 V at maximum in this working example, the disclosure is not limited thereto. It is preferable, however, that the difference in developing bias voltages to be applied is approximately 50 V.

In this working example, in addition, the photoconductor drum 65 was an amorphous silicon drum. However, without limitation to the above, a positive-charging organic photoconductor drum may be employed. When the amorphous silicon drum is employed as the photoconductor drum 65, the dielectric constant of the photosensitive layer is higher than that of the positive-charging organic photoconductor drum, and therefore the current flow is encouraged and the carrier resistance is reduced, which leads to higher measurement accuracy.

Further, although the two-component developing agent is employed in this working example, a one-component developing agent may be employed, without limitation to the above.

In addition, by calculating the surface potential with respect to a plurality of values of the charging bias, by the method described with reference to FIG. 3A to FIG. 4, the correlation between the charging bias and the surface potential (charge characteristics) can be obtained.

Figure 9:
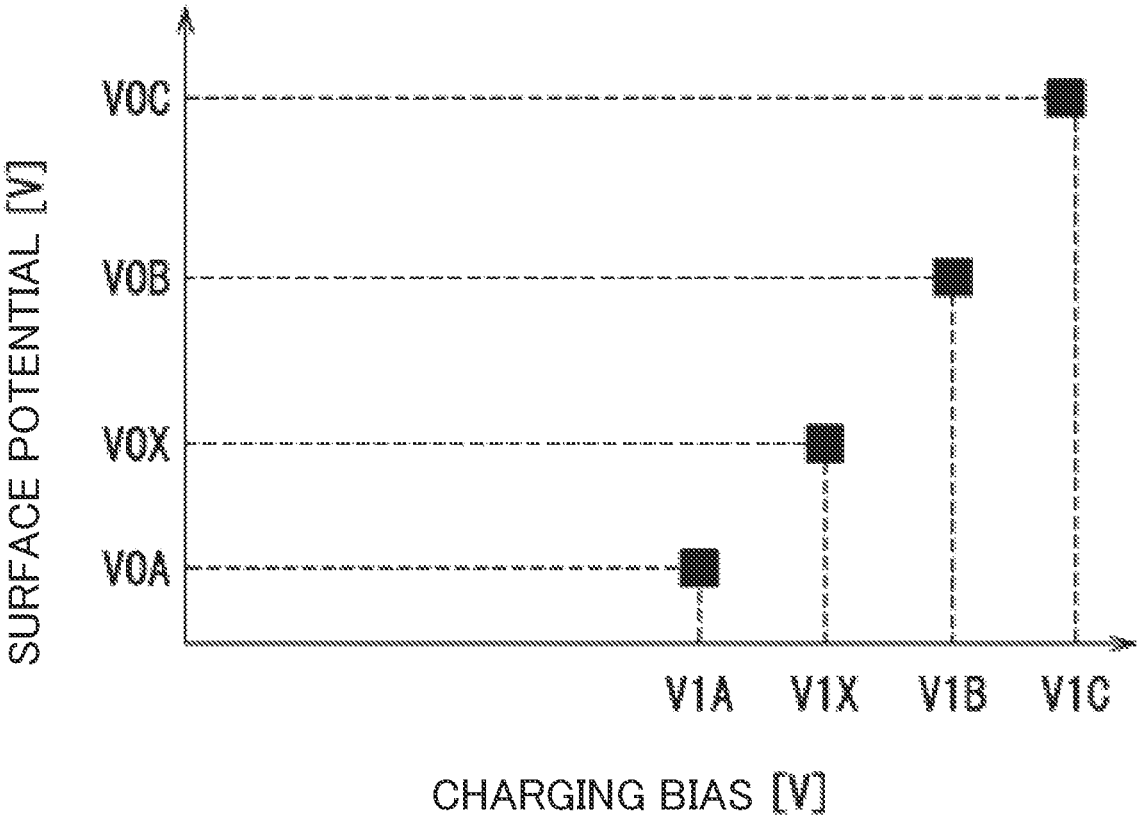
FIG. 9 is a graph showing charge characteristics of the image forming apparatus.

Referring now to FIG. 3A to FIG. 9, the charge characteristics of the image forming apparatus 1 according to this embodiment will be described hereunder. FIG. 9 is a graph showing the charge characteristics of the image forming apparatus 1. In FIG. 9, the vertical axis represents the surface potential, and the horizontal axis represents the charging bias.

For example, when the charging device 63 applies charging biases V1A, V1B, and V1C to the photoconductor drum 65, instead of a charging bias V1, and the calculation device 647 calculates the surface potential with respect to each of the charging biases, surface potentials V0A, V0B, and V0C are obtained.

The controller 10 determines the charging bias to be applied by the charging device 63 for the image forming operation, on the basis of the charge characteristics calculated as above. For example, when the surface of the photoconductor drum 65 is to be charged to the surface potential V0X, the controller 10 sets the charging bias to be applied by the charging device 63, to the charging bias V1X. Calculating thus the charge characteristics enables the surface potential desired for the image forming operation to be determined.

With the foregoing method, however, a plurality of levels of developing bias voltages, corresponding to the respective charging biases, have to be applied to the developing roller 641, and the developing current has to be measured each time, to obtain the charge characteristics. Therefore, it takes time before the desired surface potential is obtained.

Unlike the above, the following procedure is adopted in this embodiment, to shorten the time required for obtaining the surface potential.

In this embodiment, the desired surface potential for the image forming operation will be defined as surface potential V0X. For example, when the user inputs the instruction to execute the image forming operation to the image forming apparatus 1, the controller 10 causes the developing power source 648 to apply a developing bias voltage VdcX, of the same value as the surface potential V0X, to the developing roller 641. The controller 10 also causes the calculation device 647 to calculate the set value of the charging bias, corresponding to the developing bias voltage VdcX.

For example, the controller 10 causes the charging device 63 to apply the charging bias V1A to the photoconductor drum 65, thereby charging the surface of the photoconductor drum 65 to the surface potential V0A. At the same time, the current measurement device 646 measures the developing current IdA. The controller 10 determines the charging bias V1A to be applied, for example so as to make the surface potential V0A lower than the surface potential V0X.

The calculation device 647 acquires the value of the developing current IdA measured by the current measurement device 646. The calculation device 647 also acquires the charging bias V1A applied by the charging device 63.

Then the controller 10 causes the charging device 63 to apply, for example, the charging bias V1B to the photoconductor drum 65, thereby charging the surface of the photoconductor drum 65 to the surface potential V0B. At the same time, the current measurement device 646 measures the developing current IdB. The controller 10 determines the charging bias V1B to be applied, for example so as to make the surface potential V0B higher than the surface potential V0X.

The calculation device 647 acquires the value of the developing current IdB measured by the current measurement device 646. The calculation device 647 also acquires the charging bias V1B applied by the charging device 63.

Figure 10:
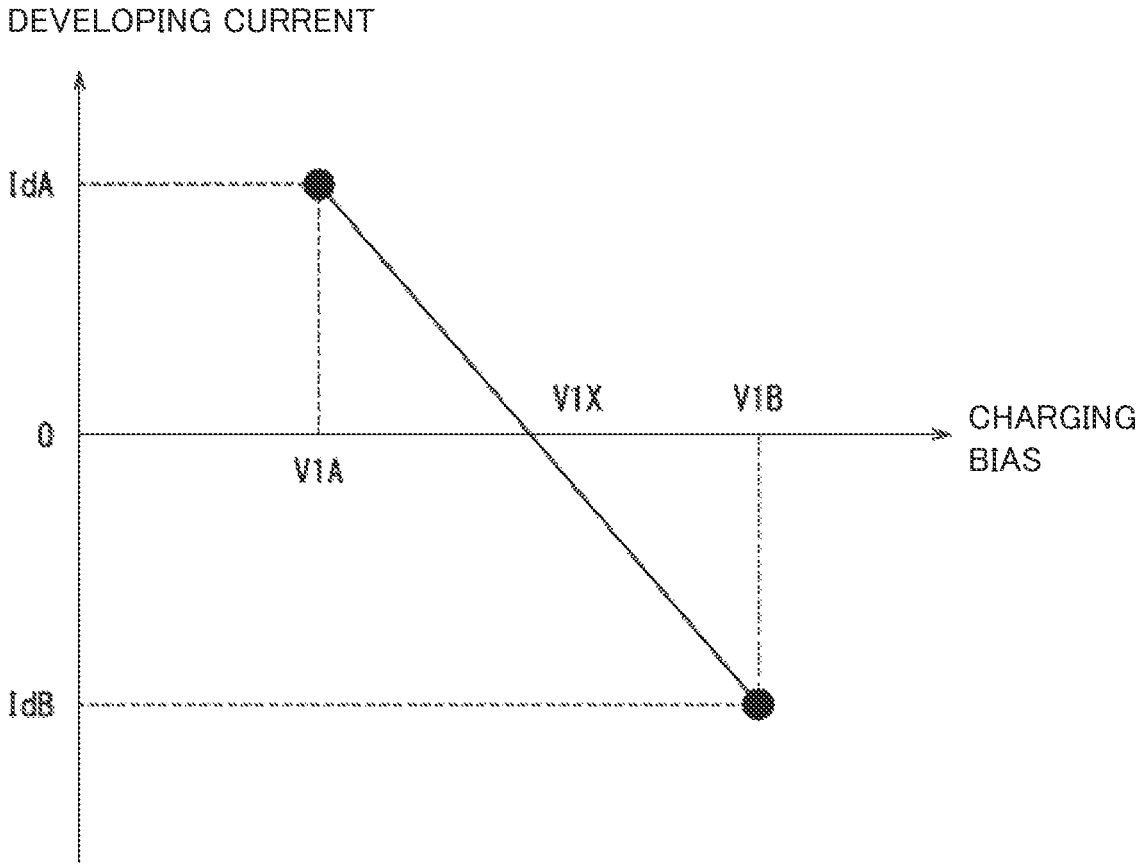
FIG. 10 is a graph showing a relation between the developing current and the charging bias.

Referring now to FIG. 3A to FIG. 4, FIG. 9, and FIG. 10, the relation between the developing currents IdA and IdB, and the calculated charging biases V1A and V1B. FIG. 10 is a graph showing the relation between the developing current and the charging bias. In FIG. 10, the vertical axis represents the developing current, and the horizontal axis represents the charging bias.

The calculation device 647 calculates the charging bias V1X that cancels the flow of the developing current, on the basis of the charging bias V1A and the developing current IdA, and the charging bias V1B and the developing current IdB, which have been acquired.

Calculating thus the charging bias V1X that cancels the flow of the developing current, by varying the charging bias with the developing bias voltage fixed, allows the calculation of the charge characteristics to be skipped, thereby shortening the time before the desired surface potential is obtained.

Although two charging biases V1A and V1B are employed to calculate the charging bias V1X in this embodiment, three or more charging biases may be employed, without limitation to the above. Increasing the number of charging biases for the calculation improves the calculation accuracy of the charging bias V1X. However, on the other hand, the time required for the calculation is also increased.

Further, the charge characteristics of the photoconductor drum 65 vary depending on the use environment, the film thickness, the transfer bias, and the roller resistance of the charging device 63, and therefore properly setting the value of the charging bias according to the charge characteristics enables the charging bias V1X to be calculated with high accuracy.

Figure 11:
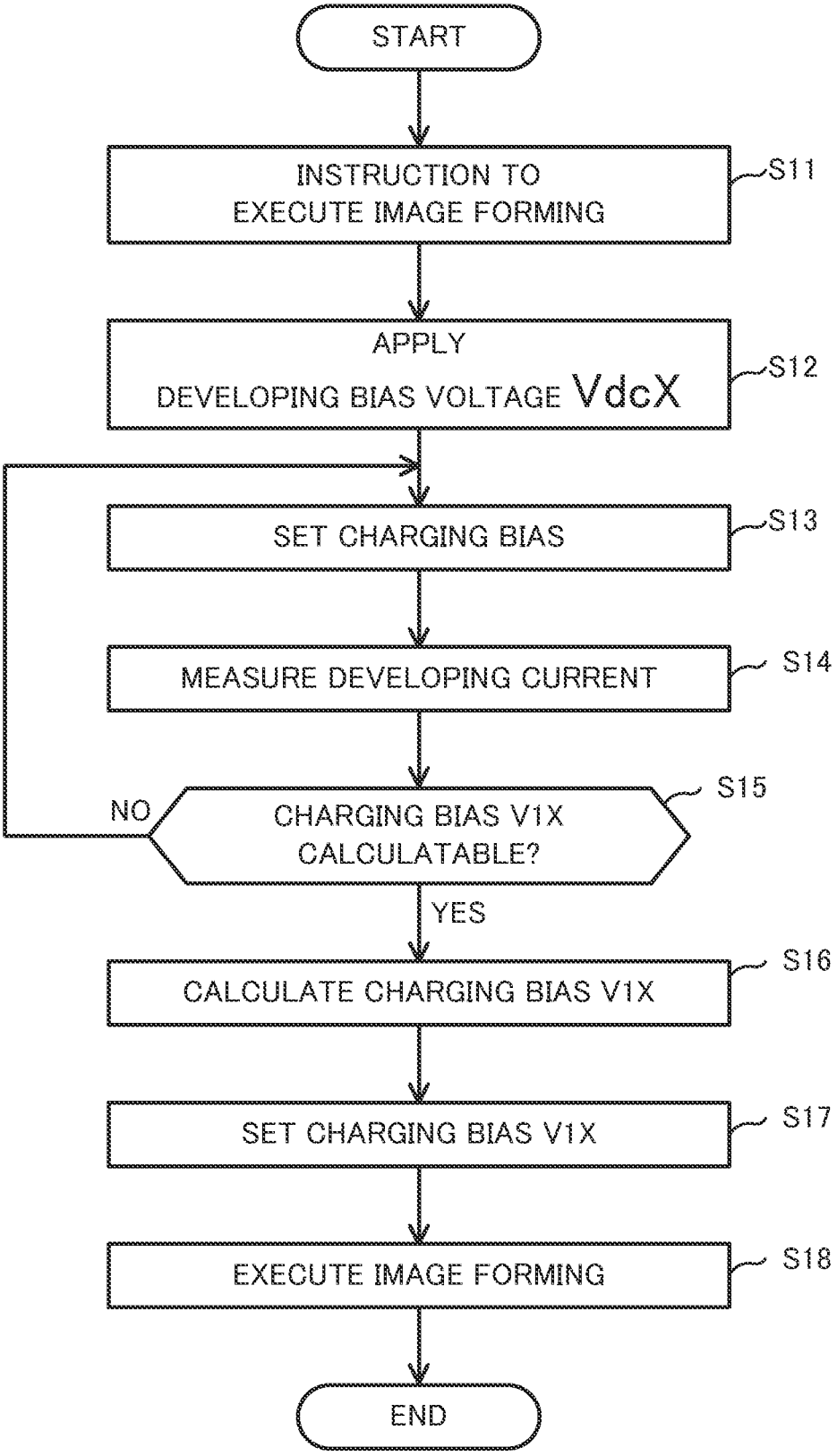
FIG. 11 is a flowchart showing a charging bias setting process according to the embodiment.

Hereunder, the charging bias setting process according to this embodiment will be described, with reference to FIG. 11. FIG. 11 is a flowchart showing the charging bias setting process according to this embodiment.

When the user inputs the instruction to execute the image forming operation to the image forming apparatus 1 (step S11), the controller 10 causes the developing power source 648 to apply a developing bias voltage VdcX of the same value as the desired surface potential V0X, to the developing roller 641 (step S12).

The controller 10 causes the charging device 63 to set a predetermined charging bias and apply that bias to the photoconductor drum 65 (step S13). The current measurement device 646 measures the developing current (step S14).

The controller 10 decides whether it is possible to calculate the charging bias V1X that cancels the flow of the developing current (step S15). In the case where a sufficient amount of developing current has not been measured, for the calculation of the charging bias V1X by the calculation device 647 (No at step S15), the controller 10 causes the charging device 63 to apply a different charging bias to the photoconductor drum 65 (step S13).

In contrast, when a sufficient amount of developing current has been measured, for the calculation of the charging bias V1X by the calculation device 647 (Yes at step S15), the controller 10 causes the calculation device 647 to calculate the charging bias V1X (step S16).

The controller 10 sets the charging bias V1X calculated by the calculation device 647 (step S17), and executes the image forming operation (step S18).

In this embodiment, for example when the charging bias V1X calculated as above is deviated from the previous calculation result, by equal to or more than a predetermined threshold, the calculation device 647 decides that the charging bias V1X is based on a measurement error. In this case, the calculation device 647 may recalculate the charging bias V1X, or adopt the previous calculation result as the charging bias V1X.

Although the calculation device 647 calculates the charging bias that cancels the flow of the developing current, in this embodiment, the calculation device 647 may instead calculate the charging bias corresponding to the developing current that flows when the surface of the photoconductor drum 65 is uncharged.

In this embodiment, the surface potential may be calculated after or during the image forming operation, without limitation to before the image forming operation. In addition, only the calculation of the surface potential may be performed, without executing the image forming operation, according to an instruction inputted by the user.

Working Example 2

Hereunder, the disclosure will be described in detail with reference to another working example. However, the disclosure is not limited to the following working example.

For the working example based on the disclosure, a multifunction peripheral was employed as the image forming apparatus 1. The multifunction peripheral was a modified model of TASKalfa2550Ci, from Kyosera Document Solutions Inc.

The experiment conditions of the multifunction peripheral were as specified below.

- Photoconductor drum 65: Amorphous silicon (a-Si) drum
- Film thickness of photoconductor drum 65: 20 μm
- Charging device 63: Outer diameter of core of charging roller 6 mm, rubber thickness 3 mm, rubber resistance 6.0 LogΩ
- Charging bias: DC and AC, Vpp 1000V frequency 3 kHz
- Blade 645: SUS430, Magnetic
- Thickness of blade 645: 1.5 mm
- Surface of developing roller 641: Knurled and blasted
- Outer diameter of developing roller 641: 20 mm
- Recess of developing roller 641: Circumferentially 80 rows
- Ratio of circumferential speed of developing roller 641 to circumferential speed of photoconductor drum 65: 1.8
- Distance between developing roller 641 and photoconductor drum 65: 0.30 mm
- AC component of developing bias voltage: Vpp 1200V, duty 50%, square wave, 8 kHz
- Toner: Particle diameter 6.8 μm, positively charged
- Carrier: Particle diameter 38 μm, resin-coated ferrite carrier
- Toner concentration: 6%
- Printing speed: 55 sheets/min.
- DC component in developing bias voltage: 250V Referring to FIG. 12 and FIG. 13, the surface potential calculated by the image forming apparatus 1 according to this working example will be described hereunder.

FIG. 12 is a table showing the developing current, measured when four levels of charging biases were applied to the photoconductor drum 65, in the image forming apparatus 1 according to this working example.

Figure 13:
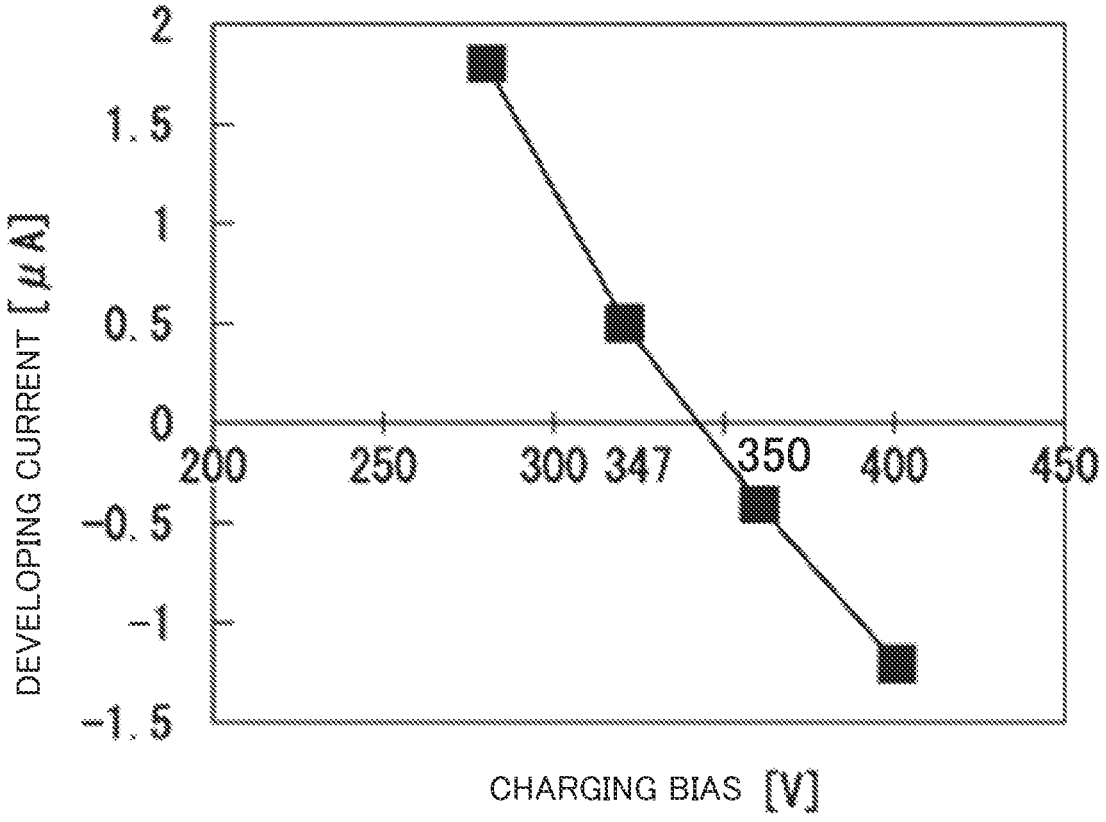
FIG. 13 is a graph showing the relation between the charging bias and the developing current, shown in FIG. 12.

FIG. 13 is a graph showing the relation between the charging bias and the developing current, shown in FIG. 12. In FIG. 13, the vertical axis represents the developing current, and the horizontal axis represents the charging bias.

In this working example, when the charging bias of 280 [V] was applied, the measured developing current was 1.8 [μA]. When the charging bias of 320 [V] was applied, the measured developing current was 0.5 [μA]. When the charging bias of 360 [V] was applied, the measured developing current was −0.4 [μA]. When the charging bias of 400 [V] was applied, the measured developing current was −1.26 [μA].

As shown in FIG. 13, the charging bias that cancels the flow of the developing current, in the image forming apparatus 1 according to this working example, is calculated as 347 [V].

In this working example, in addition, the photoconductor drum 65 was an amorphous silicon drum. However, without limitation to the above, a positive-charging organic photoconductor drum may be employed. When the amorphous silicon drum is employed as the photoconductor drum 65, the dielectric constant of the photosensitive layer is higher than that of the positive-charging organic photoconductor drum, and therefore the current flow is encouraged and the carrier resistance is reduced, which leads to higher measurement accuracy.

Further, although the two-component developing agent is employed in this working example, a one-component developing agent may be employed, without limitation to the above.

In addition, the ratio of the surface potential V0 to the charging bias V1 (V0/V1) can be obtained, upon calculating the surface potential V0. A decline in V0/V1 indicates that either the ability of the charging device 63 to supply the charge to the photoconductor drum 65 (charging capacity), or the ability of the photoconductor drum 65 to retain the charge (charge holding capacity) has declined.

However, which of the charging capacity and the charge holding capacity has declined is unable to be decided, with the value of the V0/V1 alone.

Status Decision

In this embodiment, to decide which of the charging capacity and the charge holding capacity has declined, the controller 10 calculates the relation between the surface potential V0 and the rotation speed t of the photoconductor drum 65 (V0-t relation), and performs status decision with respect to the charging device 63 or the photoconductor drum 65, on the basis of the V0-t relation obtained. The controller 10 exemplifies the status decision device in the disclosure.

To be more detailed, the image forming apparatus 1 is configured to perform a status decision mode, to decide the status of the charging device 63 or the photoconductor drum 65. The status decision mode is activated, for example, when the user inputs an instruction to perform the status decision mode to the image forming apparatus 1, while the image forming operation is not being executed.

With the start of the status decision mode, the controller 10 changes, for example, the setting of the rotation speed t, one of various set values stored in the storage device 12, to calculate the V0-t relation. In this embodiment, it will be assumed, as an example, that the rotation speed t can be set in four levels, namely the rotation speed t1 to t4.

First, the controller 10 sets the rotation speed t stored in the storage device 12 to the rotation speed t1, and controls the charging device 63, the calculation device 647, and the developing power source 648, so as to calculate the surface potential V01 corresponding to the rotation speed t1. The charging device 63, the calculation device 647, and the developing power source 648 calculate the surface potential V01, under the control of the controller 10.

Then the controller 10 sets the rotation speed t stored in the storage device 12 to the rotation speed t2, and controls the charging device 63, the calculation device 647, and the developing power source 648, so as to calculate the surface potential V02 corresponding to the rotation speed t2. The charging device 63, the calculation device 647, and the developing power source 648 calculate the surface potential V02, under the control of the controller 10.

In the mentioned process, the values of a plurality of developing bias voltages Vdc used for the calculation of the surface potential V01, and the values of a plurality of developing bias voltages Vdc used for the calculation of the surface potential V02 may be equal, or different. In addition, the number of the plurality of developing bias voltages Vdc used for the calculation of the surface potential V01, and the number of the plurality of developing bias voltages Vdc used for the calculation of the surface potential V02 may be equal, or different. When the rotation speed t is slower, the measured developing current becomes smaller, and therefore it is preferable that a larger number of developing bias voltages Vdc are employed.

Likewise, the controller 10 sets the rotation speed t3 and t4, and controls the charging device 63, the calculation device 647, and the developing power source 648, so as to calculate the surface potential V03 and V04, respectively corresponding to the rotation speed t3 and t4. The charging device 63, the calculation device 647, and the developing power source 648 calculate the surface potential V03 and V04, under the control of the controller 10.

The controller 10 acquires the rotation speed t1 to t4 and the surface potential V01 to V04, and calculates the V0-t relation.

Figure 14:
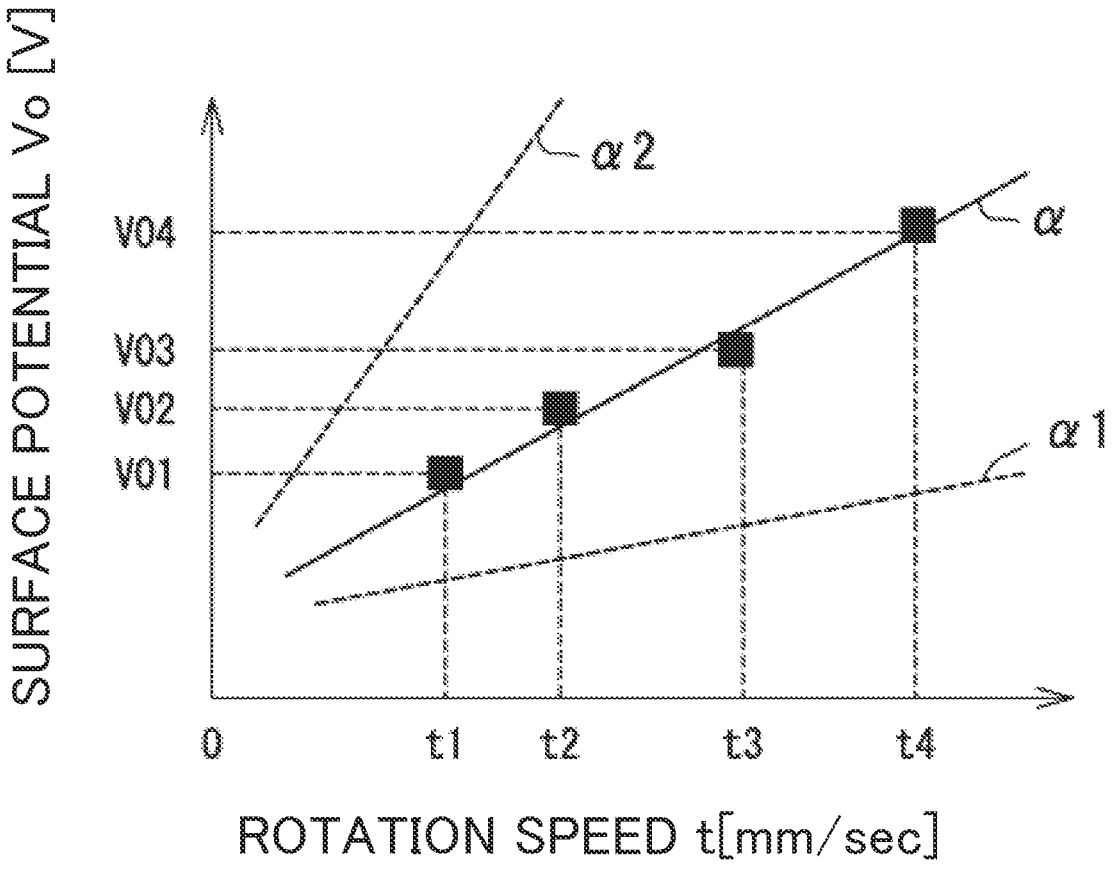
FIG. 14 is a graph showing a V0-t relation.

Hereunder, the V0-t relation will be described, with reference to FIG. 14. FIG. 14 is a graph showing the V0-t relation. In FIG. 14, the vertical axis represents the surface potential, and the horizontal axis represents the rotation speed t.

The controller 10 calculates an inclination $\alpha$, by approximating the V0-t relation between the rotation speed t1 to t4 and the surface potential V01 to V04, to a linear function. The inclination $\alpha$ is determined according to a balance between the charging capacity and the charge holding capacity, and although the inclinations shown in FIG. 14 are on the positive side, the inclination may also be on the negative side.

Typically, the travelling time from the charging position to the developing position is increased, the slower the rotation speed t is. Therefore, when the charge holding capacity declines, the surface potential V0 becomes lower compared with the charging bias V1, and the inclination $\alpha$ becomes steeper.

In contrast, the time in which the charge is supplied at the charging position is shortened, the faster the rotation speed t is. Therefore, when the charging capacity declines, the charging bias V1 becomes lower compared with the surface potential V0, and the inclination $\alpha$ becomes gentler.

The controller 10 decides the status of the charging device 63 or the photoconductor drum 65, on the basis of the inclination $\alpha$ and two thresholds $\alpha 1$ and $\alpha 2$ ($\alpha 1<\alpha 2$). More specifically, the controller 10 decides an abnormal state that the charging capacity has declined, when the inclination $\alpha$ is gentler than the threshold $\alpha 1$, and decides an abnormal state that the charge holding capacity has declined, when the inclination $\alpha$ is steeper than the threshold $\alpha 2$.

The inclination $\alpha$ varies depending on the operating condition of the image forming apparatus 1, such as the use environment of the image forming apparatus 1, the film thickness of the photoconductor drum 65, the setting of the transfer bias, and the roller resistance of the charging device 63. Accordingly, it is preferable that the thresholds $\alpha 1$ and $\alpha 2$ are variable values to be determined, for example, on the basis of detection results from a sensor for detecting the use environment, and various set values.

Although the rotation speed t is set in four levels as an example in this embodiment, the rotation speed t may be set in three levels or less, or five levels or more. However, an increase in number of levels prolongs the time required for the calculation of the V0-t relation, which leads to degraded productivity. Therefore, it is preferable to set a fewer number of levels.

For example, when it can be presumed that the V0-t relation approximate to a linear function does not incur a serious error of the inclination $\alpha$, it suffices to set at least two levels. On the other hand, when a serious error is unavoidable unless the V0-t relation is approximate to a quadratic function, it is necessary to set three or more levels. Here, when the V0-t relation is not approximate to the linear function, the inclination $\alpha$ varies depending on linear speed. Therefore, it is preferable to determine the calculation method of the inclination $\alpha$, for example substituting a predetermined rotation speed t into a formula obtained by first-order differentiation of the approximate function with the linear speed.

Self-Recovery Process

In this embodiment, the controller 10 is configured to perform a self-recovery process, including changing various set values depending on the result of the status decision with respect to the charging device 63 or the photoconductor drum 65. The controller 10 exemplifies the changing device in the disclosure.

For example, when the controller 10 decides that the charge holding capacity has declined, the controller 10 performs the self-recovery process so as to make the inclination $\alpha$ gentler. The charge holding capacity declines when the carrier present inside the photoconductor drum 65 is electrically neutralized with the charge on the surface of the photoconductor drum 65. The carrier inside the photoconductor drum 65 increases when the transfer current flowing in the transfer device 7 is large, and when the photoconductor drum 65 has a high temperature.

Accordingly, the controller 10 maintains the power supply to the components of the image forming apparatus 1, with the transfer current being restricted from flowing (burn-in aging). The controller 10 also causes the components to release heat, to restrict the heat from residing inside the image forming apparatus 1.

Likewise, when the controller 10 decides that the charging capacity has declined, the controller 10 performs the self-recovery process so as to make the inclination α steeper. Typically, the charging capacity declines owing to an increase in electrical resistance of the charging roller of the charging device 63. When the electrical resistance increases, the current flowing from the charging roller to the charging position (corresponding to the charge supply amount per unit time) is reduced, according to the Ohm's law. Accordingly, a sufficient amount of charge is unable to be supplied to the photoconductor drum 65 at the charging position, and therefore the surface potential V0 further declines at the developing position. Here, the electrical resistance of the charging roller significantly increases, under a low-temperature and low-humidity environment. In particular, the resistance of an ion conduction type charging roller is more dependent on temperature and humidity, compared with an electronic conduction type.

Therefore, the controller 10 performs the burn-in aging, for example by causing the fixing device 8 and other components to heat up the heater 81, so as to increase the temperature inside the image forming apparatus 1. Here, it is preferable to set the charging bias taking in consideration, in advance, that excessive application of the charging bias during the burn-in aging leads to an increase in electrical resistance of the charging roller.

Figure 15:
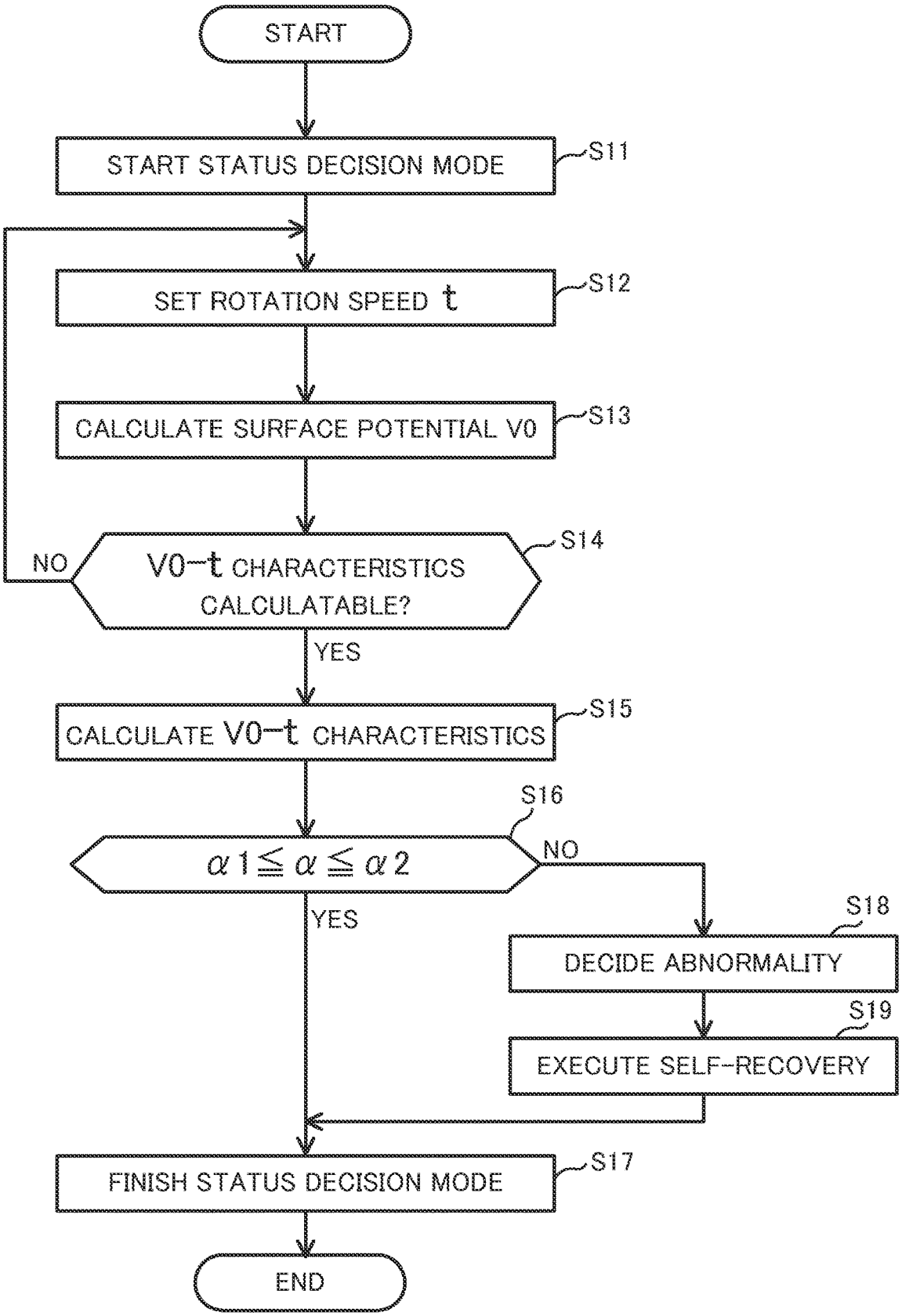
FIG. 15 is a flowchart showing a status decision process according to the embodiment.

Hereunder, the status decision process according to this embodiment will be described, with reference to FIG. 15. FIG. 15 is a flowchart showing the status decision process according to this embodiment.

When the status decision mode is activated (step S11), the controller 10 sets the rotation speed t of the photoconductor drum 65 (step S12), and causes the charging device 63, the calculation device 647, and the developing power source 648 to calculate the surface potential corresponding to the rotation speed t that has been set (step S13).

The controller 10 decides whether the V0-t relation can be calculated (step S14). Upon deciding that the V0-t relation is unable to be calculated (No at step S14), the controller 10 changes the rotation speed t of the photoconductor drum 65 (step S12), and causes the charging device 63, the calculation device 647, and the developing power source 648 to calculate the surface potential corresponding to the rotation speed t that has been changed (step S13).

In contrast, upon deciding that the V0-t relation can be calculated (Yes at step S14), the controller 10 calculates the V0-t relation on the basis of the plurality of set values of the rotation speed t and the respectively corresponding values of the surface potential V0 (step S15).

The controller 10 compares the inclination α of the V0-t relation (step S16). When the inclination α is in the range between the threshold α1 and the threshold α2, both ends inclusive (Yes at step S16), the controller 10 decides that the charging capacity and the charge holding capacity are normal, and finishes the status decision mode (step S17).

In contrast, when the inclination α is outside of the range between the threshold α1 and the threshold α2, both ends inclusive (No at step S16), the controller 10 decides that either the charging capacity or the charge holding capacity is abnormal (step S18), and performs the self-recovery process (step S19). Then the controller 10 finishes the status decision mode (step S17).

Figure 16:
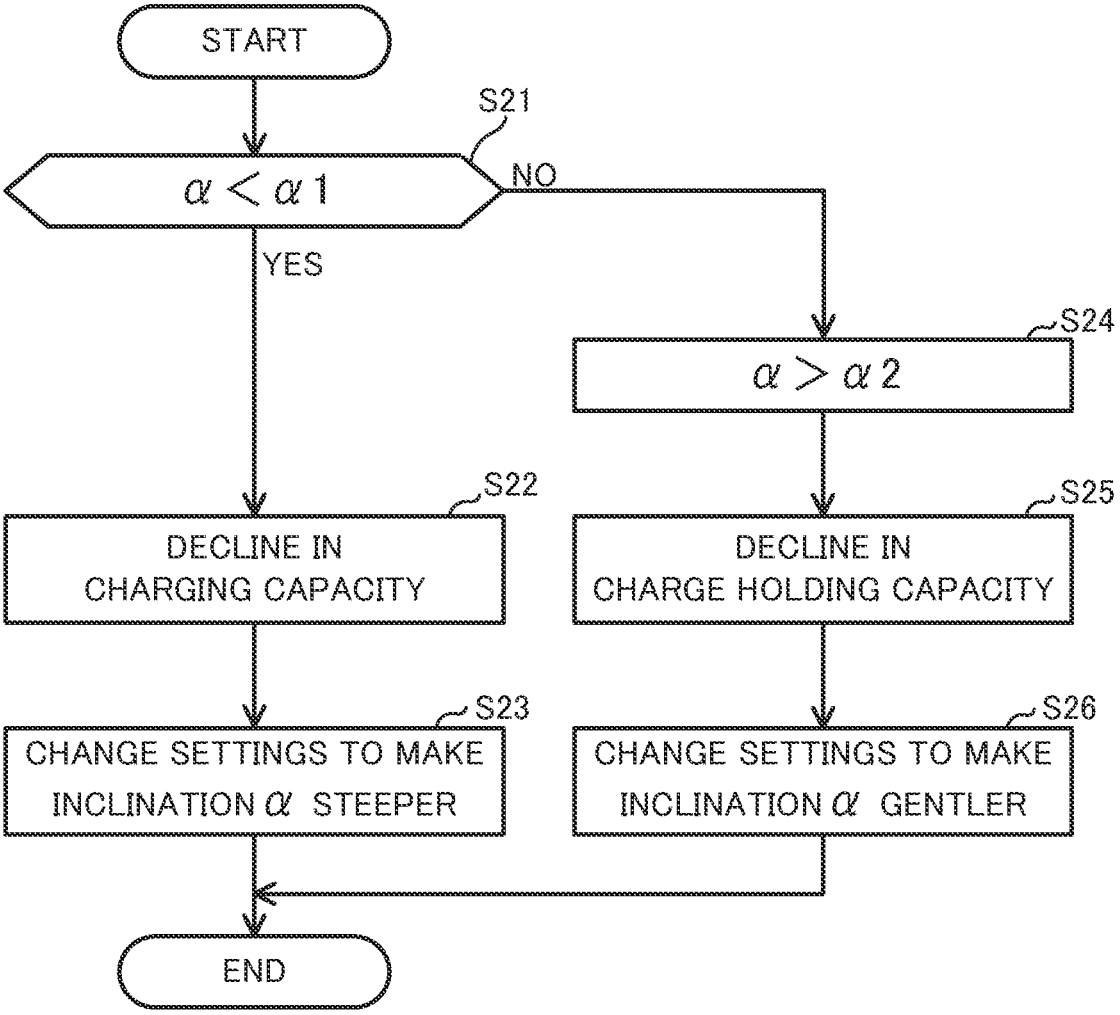
FIG. 16 is a flowchart showing a self-recovery process according to the embodiment.

Hereunder, the self-recovery process according to this embodiment will be described, with reference to FIG. 16. FIG. 16 is a flowchart showing the self-recovery process according to this embodiment. FIG. 16 represents a detailed breakdown of step S19 in FIG. 15.

First, the controller 10 compares the inclination α of the V0-t relation (step S21). When the inclination α is gentler than the threshold α1 (Yes at step S21), the controller 10 decides that the charging capacity has declined (step S22), and changes various set values so as to make the inclination α steeper (step S23). Then the controller 10 finishes the self-recovery process.

In contrast, when the inclination α is steeper than the threshold α2 (No at step S21, and step S24), the controller 10 decides that the charge holding capacity has declined (step S25), and changes various set values so as to make the inclination α gentler (step S26). Then the controller 10 finishes the self-recovery process.

Working Example 3

Hereunder, the disclosure will be described in detail with reference to another working example. However, the disclosure is not limited to the following working example.

For the working example based on the disclosure, a multifunction peripheral was employed as the image forming apparatus 1. The multifunction peripheral was a modified model of TASKalfa2550Ci, from Kyosera Document Solutions Inc.

The experiment conditions of the multifunction peripheral were as specified below.

- Photoconductor drum 65: Amorphous silicon (a-Si) drum
- Film thickness of photoconductor drum 65: 20 μm
- Charging device 63: Outer diameter of core of charging roller 6 mm, rubber thickness 3 mm, rubber resistance 6.0 LogΩ
- Charge bias voltage: DC only
- Blade 645: SUS430, Magnetic
- Thickness of blade 645: 1.5 mm
- Surface of developing roller 641: Knurled and blasted
- Outer diameter of developing roller 641: 20 mm
- Recess of developing roller 641: Circumferentially 80 rows
- Ratio of circumferential speed of developing roller 641 to circumferential speed of photoconductor drum 65: 1.8
- Distance between developing roller 641 and photoconductor drum 65: 0.30 mm
- AC component of developing bias voltage: Vpp 1200V, duty 50%, square wave, 8 kHz
- Toner: Particle diameter 6.8 μm, positively charged
- Carrier: Particle diameter 38 μm, resin-coated ferrite carrier
- Toner concentration: 6%
- Printing speed: 55 sheets/min.

Figure 18:
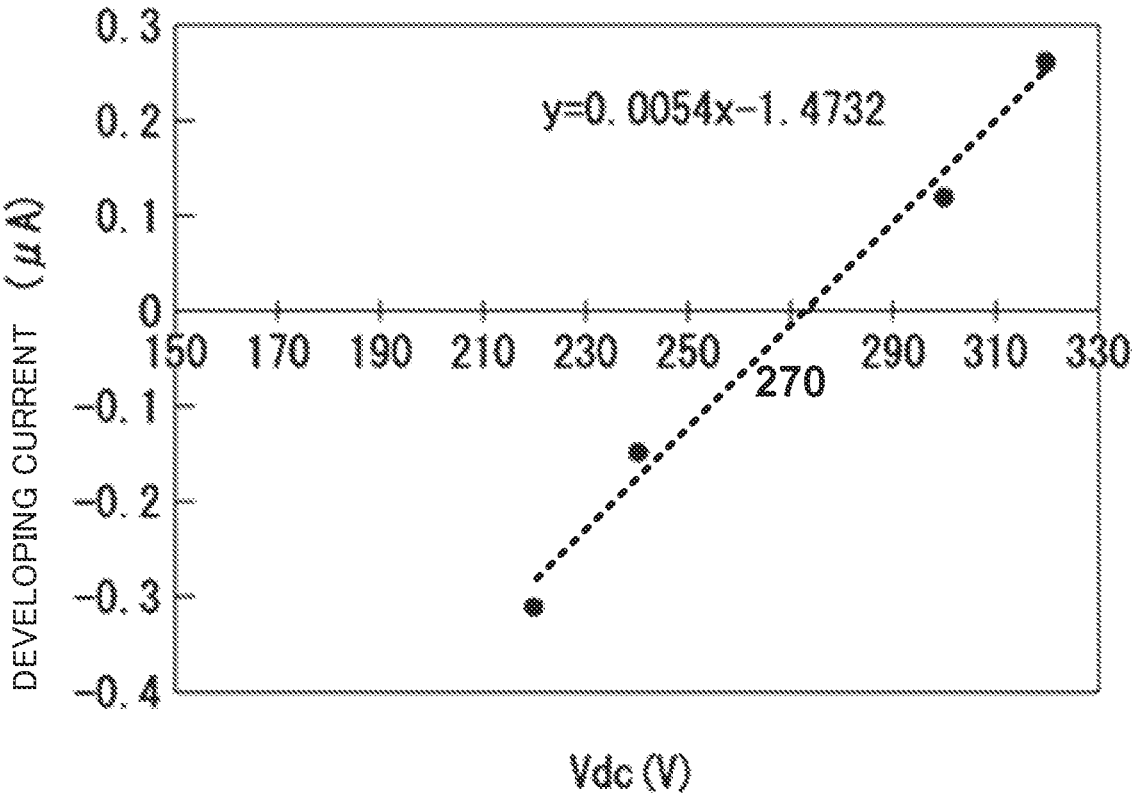
FIG. 18 is a graph showing the relation between the developing bias voltage and the developing current, shown in FIG. 17.

Referring to FIG. 17 and FIG. 18, the surface potential calculated by the image forming apparatus 1 according to this working example will be described hereunder.

FIG. 17 is a table showing the developing current, measured when the rotation speed t was set to 280 [mm/sec], and four levels of developing bias voltages were applied to the developing roller 641, in the image forming apparatus 1 according to this working example.

FIG. 18 is a graph showing the relation between the developing bias voltage and the developing current, shown in FIG. 17. In FIG. 18, the vertical axis represents the developing current, and the horizontal axis represents the charging bias.

In this working example, when the developing bias voltage of 220 [V] was applied, the measured developing current was −0.31 [μA]. When the developing bias voltage of 240 [V] was applied, the measured developing current was −0.15 [μA]. When the developing bias voltage of 300 [V] was applied, the measured developing current was 0.12 [μA]. When the developing bias voltage of 320 [V] was applied, the measured developing current was 0.26 [μA].

As shown in FIG. 18, the surface potential was calculated as 273 [V], in the image forming apparatus 1 according to this working example.

Referring to FIG. 19 to FIG. 22, the V0-t relation calculated by the image forming apparatus 1 according to this working example will be described hereunder.

FIG. 19 is a table showing the surface potential, calculated when four levels of rotation speed t were set, in the image forming apparatus 1 according to this working example.

Figure 20:
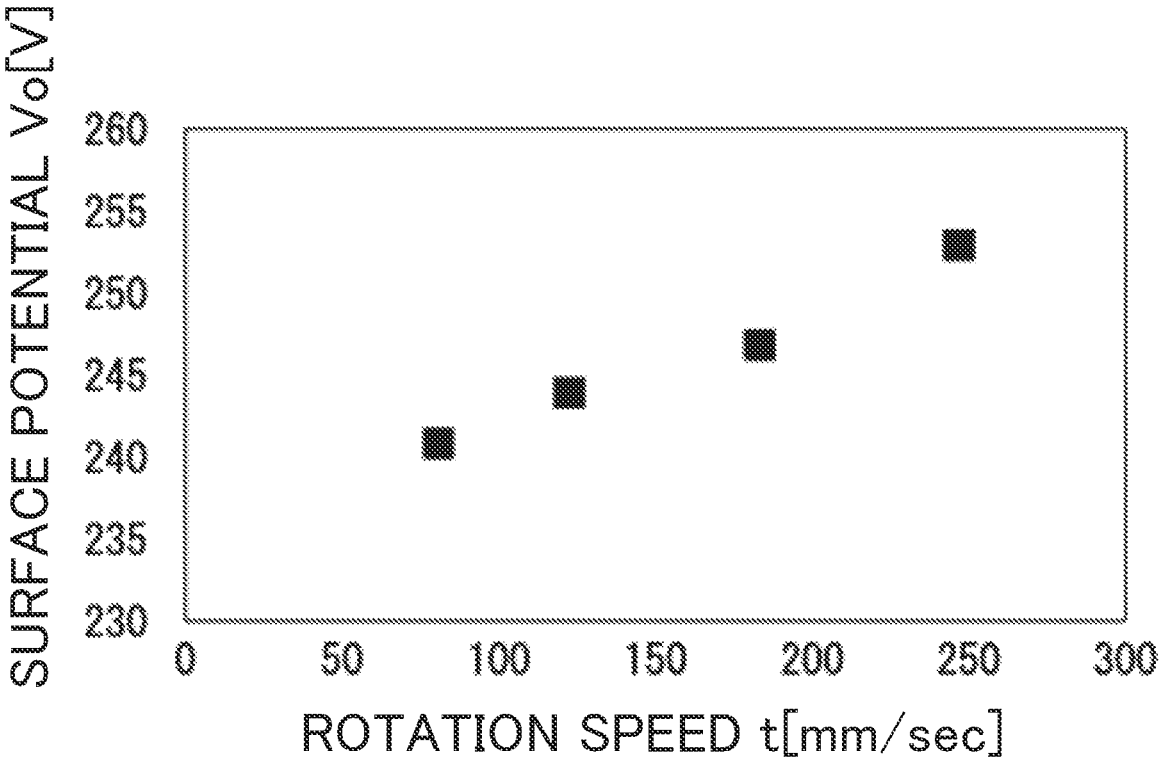
FIG. 20 is a graph showing the V0-t relation between the rotation speed t and the surface potential, shown in FIG. 19.

FIG. 20 is a graph showing the V0-t relation between the rotation speed t and the surface potential, shown in FIG. 19. In FIG. 20, the vertical axis represents the surface potential, and the horizontal axis represents the rotation speed t.

In this working example, when the rotation speed t was 245 [mm/sec], the calculated surface potential was 253 [V]. When the rotation speed t was 183 [mm/sec], the calculated surface potential was 247 [V]. When the rotation speed t was 122 [mm/sec], the calculated surface potential was 244 [V]. When the rotation speed t was 80 [mm/sec], the calculated surface potential was 241 [V].

As shown in FIG. 20, the inclination α was calculated as 0.072, by the image forming apparatus 1 according to this working example.

FIG. 21 is a table showing the surface potential, calculated when three levels of rotation speed t, different from FIG. 19 and FIG. 20, were set in the image forming apparatus 1 according to this working example.

Figure 22:
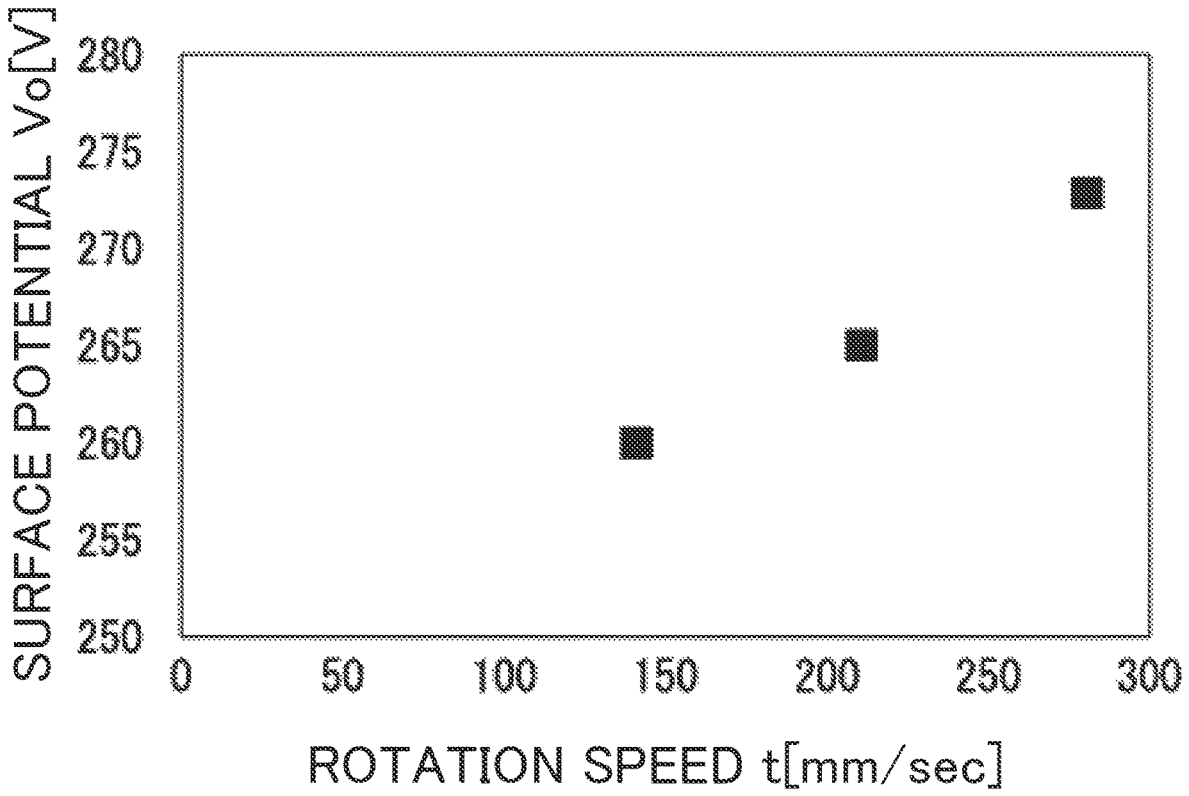
FIG. 22 is a graph showing the V0-t relation between the rotation speed t and the surface potential shown in FIG. 21.

FIG. 22 is a graph showing the V0-t relation between the rotation speed t and the surface potential, shown in FIG. 21. In FIG. 22, the vertical axis represents the surface potential, and the horizontal axis represents the rotation speed t.

In this working example, when the rotation speed t was 280 [mm/sec], the calculated surface potential was 273 [V]. When the rotation speed t was 210 [mm/sec], the calculated surface potential was 265 [V]. When the rotation speed t was 140 [mm/sec], the calculated surface potential was 260 [V].

As shown in FIG. 22, the inclination α was calculated as 0.093, by the image forming apparatus 1 according to this working example.

Although the difference in developing bias voltages to be applied was set to 100 V at maximum in this working example, the disclosure is not limited thereto. It is preferable, however, that the difference in developing bias voltages to be applied is approximately 50 V.

In this working example, in addition, the photoconductor drum 65 was an amorphous silicon drum. However, without limitation to the above, a positive-charging organic photoconductor drum may be employed. When the amorphous silicon drum is employed as the photoconductor drum 65, the dielectric constant of the photosensitive layer is higher than that of the positive-charging organic photoconductor drum, and therefore the current flow is encouraged and the carrier resistance is reduced, which leads to higher measurement accuracy.

Further, although the two-component developing agent is employed in this working example, a one-component developing agent may be employed, without limitation to the above.

Now, the current monitored by the electrophotography apparatus according to the background art is susceptible to the secular changes of the photosensitive body or the charging components, and is therefore unstable and prone to involve an error. Accordingly, the accuracy of the surface potential on the photosensitive body may be impaired. With the configuration according to the foregoing embodiments, in contrast, the surface potential of the image carrier can be obtained with high accuracy, without depending on expensive sensors such as a surface potential sensor.

The embodiments of the disclosure have been described as above, with reference to the drawings, namely FIG. 1 to FIG. 22. However, the disclosure is not limited to the foregoing embodiments, but may be implemented in various manners without departing from the scope of the disclosure. The drawings schematically illustrate the essential elements for the sake of ease in understanding, and the thickness, length, or the number of pieces of the illustrated elements may be different from the actual ones. Further, the material, shape, or size of the elements referred to in the foregoing embodiments are merely exemplary, and may be modified as desired, without substantially compromising the benefits provided by the disclosure.

INDUSTRIAL APPLICABILITY

The disclosure is applicable to the field of image forming apparatuses.

What is claimed is:

1. An image forming apparatus comprising:

an image carrier on a surface of which an electrostatic latent image is formed;

a charging device that electrically charges the image carrier;

a developing device that forms a toner image, by supplying toner to the image carrier and developing the electrostatic latent image formed on the image carrier;

a developing power source that applies a predetermined developing bias voltage to the developing device;

a current measuring device that measures a developing current flowing in the developing device; and a calculation device that calculates a surface potential of the image carrier, on a basis of the developing current measured by the current measuring device, wherein the developing power source applies the developing bias voltage of a plurality of levels to the developing device, the current measurement device measures the developing current corresponding to the developing bias voltage of each level, the calculation device calculates the surface potential on a basis of each value of the developing current, and the developing power source applies a cleaning bias voltage to the developing device, before applying the developing bias voltage of each of the plurality of levels, wherein the cleaning bias voltage is in a range between a minimum value and a maximum value, both ends inclusive, of the developing bias voltage of the plurality of levels.

2. The image forming apparatus according to claim 1, wherein the developing power source applies the cleaning bias voltage to the developing device, for a period longer than a period in which a developing roller of the developing device makes one rotation.

3. The image forming apparatus according to claim 2, wherein a period in which the cleaning bias voltage is to be applied to the developing device is determined on a basis of toner concentration and a toner charge amount in the developing device.

4. An image forming apparatus comprising:

an image carrier on a surface of which an electrostatic latent image is formed;

a charging device that electrically charges the image carrier;

a developing device that forms a toner image, by supplying toner to the image carrier and developing the electrostatic latent image formed on the image carrier;

a developing power source that applies a predetermined developing bias voltage to the developing device;

a current measuring device that measures a developing current flowing in the developing device:

a calculation device that calculates a surface potential of the image carrier, on a basis of the developing current measured by the current measuring device; and a status decision device that decides a status of the image carrier or the charging device, on a basis of the surface potential calculated by the calculation device and rotation speed of the image carrier, wherein the calculation device calculates the surface potential with respect to a plurality of values of the rotation speed, and the status decision device decides which of the image carrier and the charging device is abnormal, on a basis of a correlation between the plurality of values of the surface potential calculated by the calculation device, and the rotation speed.

5. The image forming apparatus according to claim 4, wherein the status decision device approximates the correlation to a linear function, and decides a status of the image carrier or the charging device, on a basis of an inclination of the linear function.

6. The image forming apparatus according to claim 5, wherein the status decision device decides an abnormal state that charging capacity of the charging device, for supplying a charge to the image carrier, has declined, when the inclination of the linear function is gentler than a first threshold.

7. The image forming apparatus according to claim 5, wherein the status decision device decides an abnormal state that charge holding capacity of the image carrier for retaining the charge has declined, when the inclination of the linear function is steeper than a second threshold steeper than the first threshold.

8. The image forming apparatus according to claim 5, further comprising a changing device that changes set values according to decision results provided by the status decision device, wherein the changing device changes the set values so as to make the inclination of the linear function steeper, when the status decision device decides that the charging capacity of the charging device has declined, and changes the set values so as to make the inclination of the linear function gentler, when the status decision device decides that the charge holding capacity of the image carrier has declined.

9. An image forming apparatus comprising:

an image carrier on a surface of which an electrostatic latent image is formed;

a charging device that electrically charges the image carrier;

a developing device that forms a toner image, by supplying toner to the image carrier and developing the electrostatic latent image formed on the image carrier;

a developing power source that applies a predetermined developing bias voltage to the developing device;

a current measuring device that measures a developing current flowing in the developing device; and a calculation device that calculates a surface potential of the image carrier, on a basis of the developing current measured by the current measuring device, wherein the calculation device calculates a set value of the charging bias corresponding to the predetermined developing bias voltage, on a basis of the developing current measured by the current measurement device, the charging device sets the charging bias of a plurality of levels to be applied to the image carrier, when the developing power source is applying the predetermined developing bias voltage to the developing device, and the current measurement device measures the corresponding developing current, with respect to the charging bias of each of the plurality of levels, wherein the charging bias of the plurality of levels include the charging bias that makes the surface potential of the image carrier larger than the predetermined developing bias voltage, and the charging bias that makes the surface potential of the image carrier smaller than the predetermined developing bias voltage.

* * * * *